US008961750B2

(12) United States Patent
Bakhir et al.

(10) Patent No.: US 8,961,750 B2
(45) Date of Patent: Feb. 24, 2015

(54) ELECTROCHEMICAL MODULAR CELL FOR PROCESSING ELECTROLYTE SOLUTIONS

(75) Inventors: Vitold Mikhailovich Bakhir, Moscow (RU); Yury Georgievich Zadorozhny, Moscow (RU); Yury Ivanovich Komolikov, Ekaterinburg (RU); Vadim Gennadievich Panichev, Moscow (RU); Taras Borisovich Barabash, Moscow (RU)

(73) Assignee: Vitold Mikhailovich Bakhir, Mascow (RU)

( * ) Notice: Subject to any disclaimer, the term of this patent is extended or adjusted under 35 U.S.C. 154(b) by 450 days.

(21) Appl. No.: 13/131,266

(22) PCT Filed: Dec. 3, 2008

(86) PCT No.: PCT/RU2008/000740

§ 371 (c)(1),
(2), (4) Date: May 26, 2011

(87) PCT Pub. No.: WO2010/064946

PCT Pub. Date: Jun. 10, 2010

(65) Prior Publication Data

US 2011/0226615 A1 Sep. 22, 2011

(51) Int. Cl.

| | |
|---|---|
| ***C25B 9/00*** | (2006.01) |
| ***C25B 9/08*** | (2006.01) |
| ***C25B 13/02*** | (2006.01) |

(52) U.S. Cl.

CPC ..... *C25B 9/08* (2013.01)
USPC ..... 204/260; 204/242; 204/252; 204/295

(58) Field of Classification Search

CPC ..... C25B 9/00; C25B 9/08; C25B 9/16
USPC ..... 204/242, 260, 252, 295
See application file for complete search history.

(56) References Cited

U.S. PATENT DOCUMENTS 4,971,696 A * 11/1990 Abe et al. ..... 210/500.25
5,635,040 A 6/1997 Bakhir et al.

(Continued)

FOREIGN PATENT DOCUMENTS

| | | | |
|---|---|---|---|
| RU | 2088693 | C1 | 8/1997 |
| RU | 2130786 | C1 | 5/1999 |
| WO | 98/58880 | A1 | 12/1998 |

OTHER PUBLICATIONS

Fioshin, M.Y., et al., "Electrochemical Systems in Synthesis of Chemical Products", Ed. Kozlova Vi., M, Khimiya, 1985 with partial English translation.

(Continued)

*Primary Examiner* — Zulmariam Mendez
(74) *Attorney, Agent, or Firm* — Ladas & Parry LLP

(57) ABSTRACT

The invention relates to the production of different chemical products by the electrochemical processing of electrolyte solutions of different concentrations. A cylindrical electrochemical cell for processing solutions comprises an inner, hollow, tubular anode, an outer, cylindrical cathode, and a permeable, tubular, ceramic diaphragm that is arranged between said anode and cathode and divides the interelectrode space into anode and cathode chambers so that a working section of the cell is formed. The cell comprises units for mounting, securing and sealing the electrodes and the diaphragm, which are located at the end sections of the cell, and devices for supplying and removing the processed solutions. The cathode and anode of the cell are made of titanium tubes; furthermore, the ratio of the cross-sectional area of the cathode chamber to the total cross-sectional area of the anode chamber and the diaphragm ranges from 0.9 to 1.0, and the length of the working section of the cell is 15-25 times the outside diameter of the anode. The invention makes it possible to preserve the stability of the hydrodynamic characteristics of the electrode chambers and the electric field characteristics, intensify the electrolysis process and extend the cell functionalities.

9 Claims, 14 Drawing Sheets

(56) References Cited

U.S. PATENT DOCUMENTS

| | | | | |
|---|---|---|---|---|
| 5,783,052 | A * | 7/1998 | Bakhir et al. | 204/260 |
| 2001/0020416 | A1* | 9/2001 | Yoshikawa et al. | 95/45 |

OTHER PUBLICATIONS

Partial English translation of RU 2088693 C1.
Partial English translation of RU 2130786 C1.

* cited by examiner

ELECTROCHEMICAL MODULAR CELL FOR PROCESSING ELECTROLYTE SOLUTIONS

FIELD OF THE INVENTION

The present invention relates to the applied chemistry, in particular, to devices for the electrochemical processing of electrolyte solutions and can be used in the production of different chemical products by the electrochemical processing of electrolyte solutions of different concentrations, including the electrochemical adjusting the acid-base and redox properties and the catalytic activity of dilute aqueous solutions of electrolytes of a concentration usually ranging from 0.01 to 0.1 mol/l and other low-conduction liquids.

BACKGROUND OF THE INVENTION

In applied chemistry, there are used electrolytic cells of different designs for the processing of water and aqueous solutions and production of different chemical products; in particular, flow-through cells comprising flat electrodes [e.g., U.S. Pat. No. 5,427,658, C25B 9/00; C25B 15/08, 1995] or electrolytic cells comprising coaxially arranged tubular electrodes and a diaphragm arranged between the electrodes [e.g., JP 02274889 A, C25B 9/00, 1989].

The closest prior art technical solution and attainable result involve an electrochemical modular cell comprising coaxially arranged tubular outer and inner electrodes made in the form of tube lengths and a permeable ceramic diaphragm arranged coaxially therewith [WO 98/58880, C02F 1/461, 1998].

That technical solution has been chosen as a prototype.

The known solution permits making modular electrolytic cells to attain the required efficiency by way of coupling a number of electrochemical modular cells so that to reduce the costs of designing and manufacturing the electrolytic cells of a constant output, to unify the parts and units, and to reduce the time of mounting and maintaining the cells.

The known electrochemical modular cell ensures the effective processing of water or aqueous solutions at a low rate of energy consumption. The device is simple enough in operating and easy in mounting into units such as the diaphragm flow-through electrochemical reactors of a prescribed productive capacity (output).

However, the known device evince a number of drawbacks.

The known device is intended for the processing of metal chloride solutions and can not be effective in the processing of other types of solutions. Moreover, cylindrical electrolytic cells comprising a diaphragm evince a relatively low output characteristics and are significantly inferior in this regard to electrolytic cells comprising bulk or fluidized-bed electrodes [e.g., Fioshin M. Ya., Smirnova M. G. Elektrokhimicheskie sistemy v sinteze khimicheskikh produktov (Electrochemical systems in the synthesis of chemical products), M.: Khimiya, 1985, p. 216-223, Table VII. 6, Fig. VII.34].

SUMMARY OF THE INVENTION

The technical result obtainable upon embodiment of the present invention is providing the feasibility of intensifying the electrolysis process in a cylindrical diaphragm-type cell by way of improvement of the cell design and selection of the optimum size ratio of the basic elements—electrodes and a diaphragm. The result is enhanced due to the use of a diaphragm and electrodes with a different ratio of the geometrical (apparent) and true (physical) surface areas and also due to the use of a cell diaphragm made of materials, the combination of which imparts the electroosmotic activity to the capillary-porous structure of the diaphragm. Also, the obtainable technical result of the invention consists in extending the cell functionalities in processing electrolyte solutions of different chemical compositions and concentrations.

The claimed technical result is attained due to the fact that a cylindrical electrochemical cell for the processing of solutions comprises an inner tubular anode, an outer cylindrical cathode, a permeable tubular ceramic diaphragm arranged between the anode and cathode and dividing the interelectrode space into the anode and cathode chambers, and units for mounting, securing, and sealing the electrodes and the diaphragm which are located at the end sections of the cell, and devices for supplying and removing the solutions into and out of the electrode chambers, the cathode, anode, and diaphragm are mounted in units and are connected with the devices for supplying and removing the solutions so as to form the working section of the cell, along the full length of which the constant hydrodynamic parameters of the electrode chambers and the electric field parameters are maintained. The cathode and anode are made of titanium tubes with the ratio of the cross-sectional area of the cathode chamber to the total cross-sectional area of the anode chamber and the diaphragm being 0.9 to 1.0 and the length of the working section of the cell being 15-25 times of the outside diameters of the anode. The anode may be made of a titanium tube with a developed outer surface, on which an electrocatalytic coating is applied, with the ratio of the true (physical) surface area of the anode and the true surface area of the cathode being equal or greater than unity. The cell diaphragm is made capillary-porous and electroosmotically active, with the true outer surface area of the diaphragm being equal or less than the true surface area of the cathode and the true inner surface area of the diaphragm being equal or less than the true surface area of the anode but less than the true outer surface area of the diaphragm. In the cell, the product of the interelectrode distance and the quotient of the division of the total true surface areas of the anode and cathode by the total volume of the electrode chambers is 3.9 to 4.1.

In the cylindrical electrochemical cell for processing solutions, a ceramic diaphragm is made of alumina grains covered with a particulated zirconium dioxide stabilized partially with oxides of rare or rare-earth metals and has the following composition: 60 to 90 wt % of alumina (no less than 98% of the alumina phase content is in the alpha form) and 10 to 40 wt % of zirconium dioxide (no less than 98% of the zirconium dioxide phase content is in the tetragonal modification). For stabilization of the tetragonal zirconium dioxide phase, there are used additives of one or more oxides selected from the group comprising oxides of yttrium, scandium, ytterbium, cerium, and gadolinium, in total of 1.0 to 10.0 wt %.

The units for securing the electrodes and the diaphragm may be made in the form of one or more parts made each of a dielectric material; the devices for supplying and removing the solutions into and out of the electrode chambers are made in the form of channels and sockets integrated with the unit parts.

The anode cavity may comprise devices for supplying and removing a heat-carrier.

The cell can be made such that the units for securing the electrodes and the diaphragm are made in the form of one or more parts made each of a dielectric material; the devices for supplying and/or removing the processed solution into and out of the cathode chamber are made in the form of channels and sockets integrated with the unit parts; and the devices for supplying and removing the processed solution into and out of the anode chamber are made in the form of sockets connected with the anode inner cavity and located at the ends thereof, with the anode end sections comprising apertures.

The units for securing the electrodes and the diaphragm in the cell may be made in the form of one or more parts made each of a dielectric material; the devices for supplying and removing the solutions into and out of the cathode chamber are made in the form of apertures and sockets located at the cathode end sections; and the devices for supplying and removing the processed solutions into and out of the anode chamber are made in the form of sockets connected with the internal hollow of the anode and located at the ends thereof, with the anode end sections comprising apertures. The anode can comprise additional apertures located uniformly along the length thereof throughout the whole length of the working section of the cell.

The fact that the cathode, anode, and diaphragm are arranged in units so that to form the working section of the cell (FIG. 1), along the full length of which the constant hydrodynamic, thermal, and electrophysical characteristics of the electrode chambers are maintained (the prescribed roughness of the surfaces that form the walls of the electrode chambers, equal radial spaces between the cylindrical surfaces of the electrodes and the diaphragm in all cross-sections of the working section of the cell, equal thickness of the diaphragm and the anode and cathode titanium tubes along the full length of the working section of the cell, equal electric-field intensity inside the diaphragm, and equal electric resistance between the electrodes in any one of the cross-sections of the working section of the cell) makes it possible to intensify the process of the electrochemical treatment due to the uniform movement of the processed solutions (at the equal longitudinal velocity in all points of the cross-section of the electrode chambers) to conform to the conditions of operation of a chemical reactor of ideal displacement. The velocity of the gas-liquid displacement fronts, each of which, because of a ceaseless electrochemical action, differs in temperature, concentration, chemical composition, and physicochemical properties (because of different amounts of dissolved and free gases) is determined only by a volume flow of the solutions at the entry into each of the electrode chambers. In the working section of the cell, as the size ratio is maintained, there are no stagnant zones and zones of the prevailing or retarded flows. The formation of zones of retarded flows and stagnant zones in electrode chambers is usually associated with the accumulation of an increased amount of products of electrochemical reactions therein, which possess a higher electric conductivity as compared with the initial electrolyte solution. Due to the formed heterogeneity of the conducting medium, there occurs a redistribution of the electric field lines, which is associated with local temperature fluctuations, which, in their turn, enhance the action of the other factors of generating the heterogeneity of flow. The self-sustaining and self-developing thermal and physical, electrochemical, and hydrodynamic fluctuations in the working chambers of the electrochemical systems result in the non-productive energy expenditure and decreasing the efficiency of the processes of electrochemical conversion of liquids. The manufacture of the anode and cathode of the electrochemical cell in the form of titanium tubes, which possess a low thermal inertia, makes it possible to avoid the generation and development of a longitudinal (along the cell axis) thermal interference of the fronts of displacement of the gas-liquid medium moving in the electrode chambers. The stable hydraulics conditions in the chambers of the working section of the cell is achieved when the points of entry and exit of the electrolyte solution into and out of the chamber are located at a distance that is equal or larger than the width of the electrode chamber, into which and out of which the electrolyte solution is supplied and removed.

The ratio of the cross-sectional area of the cathode chamber of the cell to the total cross-sectional area of the anode chamber and the diaphragm should be 0.8 to 1.0 and the length of the working section of the cell should be 15-25 times the outside diameter of the anode. It is with this range of ratios of the cell parameters that the circulation of the liquid in the electrode chambers is provided in the form of microtoroidal streams, wherein each microvolume of liquid in the stream repeatedly comes into contact with the peri-electrode surface (FIG. 3). The generation of microtoroidal streams in the electrode chambers increases the degree of utilization of the initial components of an electrolyte solution and provides the optimum conditions for supplying the initial agents to the electrode surface and the optimum conditions for removing the reaction products from the electrodes, with a simultaneous removal of the electrolysis gases in the form of minute bubbles that do not increase the resistance of the medium in the electrode chambers.

The effect of generation and stable existence of the microtoroidal streams ensures the effective mixing of the initial substances and the reaction products in each portion of the working section of the cell in the course of movement of the gas-liquid medium. In that case, the effect of generation and existence of the microtoroidal streams accounted for by the above-mentioned ratio makes it possible to consider the volume of the gas-liquid mixture located between any two, anyhow approximate, cross-sections as a toroidal microreactor of ideal mixing.

The above ratio ensures intensifying the most important processes, namely, hydrodynamic ones, which comprise supplying the initial substances to the electrode and removing the products of electrochemical reactions from the electrode and also the processes of removing the electrolysis gases from the interelectrode space.

This ratio can be increased or decreased by varying the cross-sectional area of the cathode chamber and the cross-sectional area of the anode chamber. A change in the ratio leads to a disturbance of the microtototoidal structure of the streams in the electrode chambers, a decrease in the mass transfer rate, and, consequently, the degradation of electrochemical processes. An increase in the cross-section of the diaphragm with the cross-sections of the electrode chambers remaining constant leads to increasing the electric and hydraulic resistances of the diaphragm and also to the degradation of the process. A decrease in the cross-section of the diaphragm with the cross-sections of the electrode chambers remaining constant leads to decreasing the mechanical strength of the diaphragm, increasing the leaking properties thereof, and decreasing the adsorption, chemical, and electroosmotic activity thereof; as a result, the separation of highly active products of electrochemical reactions during the cell operation deteriorates. The length of the working section of the cell should not be larger than 25 $D_2$ and less than 15 $D_2$, where $D_2$ is the outside diameter of the anode. With the length of the working section of the cell being less than 15 times the outside diameter of the anode, the duration of the electrochemical processing of liquid in the cell is short and the operating efficiency of the cell decreases. An increase in the length of the working section of the cell above 25 times the outside diameter of the anode leads to increasing considerably the hydraulic resistance of the cell and increasing the energy consumption because of over-filling the electrolyte with gas.

The anode may be made of a titanium tube with a developed outer surface, on which an electrocatalytic coating is applied; the cathode may be made of a titanium tube, with the inside thereof being smoother than the anode surface. The smoothness is achieved by the treatment of the work surfaces of the electrodes by any of the known methods, such as sandblasting, electrochemical etching, chemical etching, polishing, electropolishing, polishing with a grinding tool, etc. Thereby it is possible to adjust the ratio of the true (physical, working, and active) surfaces of the anode and cathode along the full length of the working section of the cell. This ratio should be equal or larger than unity; with the apparent (geometrical) surface of the anode, in accordance with the design, being less than the geometrical surface of the cathode, since the outside diameter of the anode is less than the inside diameter of the cathode. The developed physical surface of the anode permits to decrease the effective density of the anode current and increase several times the lifetime of the anodic electrocatalytic coating. The developed surface of the anode, due to a great number of microgeometrical convexities and concavities of the size not exceeding 10 μm, permits to create microelectrocatalytic regions, which differ in the electrode potential (FIG. 2). On the convexities, due to a greater density of the microdiffusion current, the oxidizing potential is higher than that in the concavities, wherein the microdiffusion current density is lower. In case of electrochemical processing of dilute electrolyte solutions, the effect permits one to obtain the anodic oxidation products via a variety of chemical reactions differing in the kinetics and equilibrium potentials. Due to the developed surface of the anode and a very low concentration of the electrolyte ions in the immediate dense and diffusion regions of the double electric layer (DEL) at the anode surface, around the metastable reaction products, such as ozone, singlet oxygen, hydrogen peroxide, and chlorine dioxide, there are formed thick ion-hydration sheaths, which preserve them in the solution for a long time and prevent their mutual neutralization, which is inevitable under usual conditions of chemical reactions.

In case of electrochemical processing of concentrated electrolyte solutions, the developed surface of the anode makes it possible to carry out the anodic oxidation with a minimum anodic polarization and to reduce thereby heat losses.

The small geometric surface of the anode, as compared with the large geometric surface of the cathode, determines the shape of the radial distribution of the electric field lines, which concentrate at the center and ensure the rapid supply of the initial agents to the anode surface within the range of action of the electric field of the DEL diffusion region, i.e., $10^{-5}$ . . . $10^{-4}$ cm, and the rapid removal of products of the electrochemical reactions from the DEL diffusion region into the solution volume.

The relatively smooth surface of the cathode promotes the formation of small bubbles of hydrogen and, due to the uniform titanium structure in the surface and near-surface layers, reduces the intensity of dissolving hydrogen in the metal (the hydrogenation process).

The diaphragm should be capillary-porous and should possess a high electroosmotic activity and different degrees of microroughness of the surfaces faced to the cathode and anode. Along the full length of the working section of the cell, the inside and outside of the diaphragm were made such that they have different prescribed roughness, i.e., the outer true or physical surface of the diaphragm should be made equal or less than the true surface of the cathode and the inner true surface of the diaphragm should be made equal or less than the true surface of the anode but less than the outer true surface of the diaphragm. The difference may be achieved either in the course of manufacturing the diaphragm or by means of the subsequent mechanical treatment of its surface. That design makes it possible to achieve the efficient operation of the electrochemical cell in the event of excess pressure in the cathode chamber over the pressure in the anode chamber, i.e., under conditions when, simultaneously with the electrochemical processing of water or of a dilute electrolyte solution, there is carried out a filtration transfer of anions and part of water from the cathode chamber to the anode chamber. The specially increased true (physical) surface of the diaphragm faced to the cathode makes it possible, without increasing considerably the filtration resistance, to retain insoluble particles of heavy metal hydroxides formed in the cathode chamber and ensure the long-term operation of the cell at a constant rate of the filtration transfer of substances through the diaphragm.

The true surface of the diaphragm faced to the anode is less than the anode true surface, so that it makes it easier to control the electromigration ion transfer from the anode chamber to the cathode chamber due to an increased concentration of cations in the near-surface layer of the diaphragm. The observable decrease in the intensity of the electromigration transfer of hydronium ions is useful and results from the suppression of the prototropic mechanism of the migration of hydronium ions in the region of the concentration polarization on the diaphragm filtering surface. Under conditions of the deficiency of "free" water molecules in the spatial charge region, there prevails the electromigratory transfer of metal cations that possess, in contrast to hydronium ions, more voluminous hydrate sheathes; the transfer accelerates due to the electroosmotic transfer of water from the anode chamber to the cathode chamber.

In case of concentrated electrolyte solutions, the electroosmotic activity of the diaphragm decreases but it is still higher as compared with ceramic diaphragms from alumina, boron oxide, zirconium oxide, and asbestos.

The electroosmotic activity of the diaphragm manifests itself by the ability thereof to create the pressure drop in the cell chamber filled with fresh drinking water of a total salinity of 0.15 to 0.2 g/l due to the electric field of 15 to 30 V/cm with a magnitude of no less than 1.5 kGs/cm$^2$. Lesser values of the pressure drop show up either an inadequate chemical composition of the diaphragm material, or an excessively large size of the capillary channel in the diaphragm body.

The product of the interelectrode distance and the quotient of the division of the total true surface areas of the anode and cathode by the total volume of the electrode chambers should be 3.9 to 4.1 for electrolyte solutions of different concentrations that can be conditionally divided into two types: dilute and concentrated.

The conditional division of solutions of inorganic electrolytes into dilute and concentrated ones is accounted for by a distinction in kind of solutions whose concentration is higher or lower 0.1 mol/l. FIG. 4 shows (1) the electric conductivity of aqueous solutions of different inorganic electrolytes—chlorides, sulfates, carbonates, and nitrates of alkali elements and the corresponding acids and bases thereof as a function of their concentration in the aqueous solution. Curve (2) shows theoretically calculated spaces between centers of electrolyte ions in the solution also as a function of concentration. A comparison of these curves shows that as the electrolyte concentration increases, the space between ions decreases and, in accordance with the theoretical calculations, the interaction between them increases. A critical concentration is that about 0.1 mol/l, as it is evident from a change in the angle of slope of curve 1. In case of electrochemically activated solutions, a rapid mutual neutralization of the most active agents occurs at a total concentration of electrolyte ions over 0.1 mol/l.

In dilute electrolyte solutions (below 0.1 mol/l), minute changes in the solute concentration lead to considerable changes in the electric conductivity of the solution, which is evidence for a predominant role of forces of ionic interaction in the processes of mass transfer and a small intensity of processes of mutual neutralization of the electrochemically activated agents-antagonists.

Hence, a lower value of the above-mentioned ratio 3.9 pertains to cells for processing solutions of a concentration below 0.1 mol/l; a higher value 4.1, to cells for processing solutions of a concentration over 0.1 mol/l. The intermediate values are characteristic of cells, wherein electrolyte solutions of different concentrations are passed through the electrode chambers but their total concentration (with an allowance for the volumetric rate) is about 0.1 mol/l.

Increasing or decreasing the above ratio is associated with a rise in power inputs for the process of electrolysis and a decrease in the yield of target products due to a loss of the efficiency of the mass transfer by the microtoroidal streams and the appearance of regions of the prevailing flow and regions of the retarded flow in the electrode chambers.

The ceramic diaphragm of the cell is made of alumina grains of the specific surface area 1 to 4 $m^2/g$ covered by alumina particles of the specific surface area 10 to 40 $m^2/g$; with the content of aluminium particles of the specific surface area 1 to 4 $m^2/g$ being 70 to 90 wt %; with no less than 99% of the alumina phase composition being in the alpha form.

The diaphragm of the cell may be made of alumina grains of the specific surface area 1 to 4 $m^2/g$ covered by a mixture of particles of titanium oxide and magnesium oxide, with the content of alumina particles being no less than 99 wt %; with no less than 99% of the alumina phase composition being in the alpha form.

The ceramic diaphragm may be made of alumina grains of the specific surface area 1 to 4 $m^2/g$ covered by zirconium dioxide particles stabilized partially with oxides of rare metals or rare-earth metals and has the following composition: 60 to 90 wt % of alumina, with no less than 98% of the alumina phase composition being in the alpha-form; 10 to 40% by weigh of zirconium dioxide, with no less than 98% of the zirconium dioxide phase composition being in the tetragonal modification. The tetragonal phase of zirconium dioxide is stabilized by addition of one or more oxides selected from the group comprising yttrium, scandium, ytterbium, cerium, and gadolinium oxides. The total amount of oxides is 1.0 to 10.0 wt %.

By maintaining the above ratios, the diaphragm chemical composition and physicochemical properties thereof ensure the sorption of high-charged metastable particles exiting from the electrodes (FIG. 5). They do not penetrate deep into the diaphragm, since their energy of interaction with the heterogeneous hydrophilic surface of the diaphragm material is higher than the energy of activation of the electromigratory transfer and so they are not subjected to utual neutralization. Therefore, the electrochemical cell can be used as an electrochemical reactor comprising an ion-selective electroosmotic diaphragm to provide for a selective ion transfer through the diaphragm by means of adjustment of the pressure gradient on the diaphragm. The value and direction of the transfer are determined by the current strength (density) and the electric field intensity in the diaphragm and the salinity of aqueous solutions on each side of the diaphragm. The electric resistance of the diaphragm with its adsorption layers made up inside and outside thereof is lower than the resistance of the electrolyte, which fills the pores, and the mobility of ions in the pores is higher than the mobility of ions in a pure solution. The stationary equilibrium of the electric field intensity in the diaphragm accounted for by the presence of the adsorption layers of charged particles is dynamic in character.

Diaphragms of this type permit the electrochemical modular cell to operate effectively under laboratory and manufacturing conditions and to be equally effective in processing dilute aqueous electrolyte solutions and concentrated aqueous-saline solutions; moreover, the diaphragm properties (its physicochemical composition and filtration ability) make it possible to work under conditions when a concentrated electrolyte solution is passed through one of the electrode chambers and in another chamber there is formed a concentrated solution comprising products of decomposition of water and ions of one kind of the electrolyte (anions or cations), whose ion-selective migration is provided due to a combination of physicochemical properties of the diaphragm and electrophysical parameters of the cell operation (FIG. 6). The choice of the diaphragm material depends on the specificity of the problem to be solved and considerations of economy.

The design of the ceramic diaphragm made of alumina grains of the specific surface area 1 to 4 $m^2/g$ provides for the required parameters of the diaphragm permeability. In fact, alumina particles covered by smaller particles of alumina, titanium and magnesium oxides, or zirconium dioxide partially stabilized with oxides of rare or rare-earth metals increase its chemical resistance.

The diaphragm made of alumina grains of the specific surface area 1 to 4 $m^2/g$ covered alumina particles of the specific surface area 10 to 4o $m^2/g$, with the content of alumina particles of the specific surface area 1 to 4 $m^2/g$ being 70 to 90 wt % and no less than 99% of the alumina phase composition being in the alpha-form, possesses a relatively high chemical resistance and is relatively cheap.

The design of the diaphragm made of alumina grains of the specific surface area 1 to 4 $m^2/g$ covered by a mixture of particles of titanium oxide and magnesium oxide, with the content of alumina particles being no less than 99 wt %, makes it possible to increase the diaphragm stability and improve the adsorption properties thereof. Moreover, no less than 99% of the alumina phase particles are in the alpha-form.

The diaphragm made of alumina grains covered by zirconium dioxide particles possesses the highest chemical stability. The diaphragm comprises: 60 to 90 wt % of alumina, with no less than 98% of the alumina phase composition being in the alpha-form; 10 to 40 wt % of zirconium dioxide, with no less than 98% of the zirconium dioxide phase composition being in the tetragonal modification. The tetragonal zirconium dioxide phase is stabilized with the addition of one or more oxides selected from the group comprising oxides of yttrium, scandium, ytterbium, cerium, and gadolinium. The total content of oxides is 1.0 to 10.0 wt %. That composition provides for the mechanical durability and stability of the structure of the diaphragm.

Variations in the ratios of the ingredients of the above-mentioned materials of the diaphragm lead to a considerable decrease in the electroosmotic activity of the capillary-porous diaphragm body and a decrease in the adsorptive-chemical activity of its surfaces facing to the electrodes.

The consistent effect of the above-mentioned parameters on the performance of the electrochemical reactor is shown in FIG. 7. The efficiency of the presently claimed technical solution is shown by invoking a diagram provided in the book "Elektrokhimicheskie sistemy v sinteze khimicheskikh produktov" [Electrochemical systems in synthesis of chemical products] (Fioshin M. Ya., Smirnova M. G., M., Khimiya, 1985, p. 222, Fig. VII.34). As can be seen from the diagram, the present technical solution exceeds in its main characteristics filter-press electrolyzers, wherein the interelectrode spaces are separated by a porous partition, and is very similar to electrolyzers comprising fluidized-bed electrodes.

A flow chart of supplying an electrolyte solution into the cell and removing the products of electrolysis may be different and depending on the chemism of the processes that place therein and properties of the final products of electrolysis. On the whole, the flow chart is determined by the design of the units for mounting, securing, and sealing the electrodes and the diaphragm and devices for supplying and removing the electrolyte solutions into and out of the electrode chambers. The units located at the end sections of the cell may be made in the form of one or more parts made each of dielectric materials. Depending on the requirements set for a process that takes place in the electrochemical cell, the devices for supplying a solution to be treated into the electrode chambers may be coupled with one unit; and the devices for removing the products of electrolysis, with another unit. Thereby, a forward flow of the solutions in the electrode chambers is provided. In case of need of a backflow, each unit shall be coupled with a device for supplying a solution into one electrode chamber and simultaneously with a device for removing the products of electrolysis from another electrode chamber. The devices for supplying a solution to be treated into the electrode chambers and removing the products of electrolysis from the electrode chambers may be made in the form of channels and sockets integrated with these parts or in the form of apertures and sockets connected with the end sections of the electrodes. The length of the cathode and/or anode and/or diaphragm is determined by the cell design and conditions of mounting the cell.

The units for mounting, securing, and sealing the electrodes and the diaphragm may be made in the form of manifolds comprising channels for supplying and removing the electrolyte solutions and a packing system. The anode and cathode shall comprise apertures for supplying the electrolyte solutions into the electrode chambers and removing the products of electrolysis from the electrode chambers.

Figure 1:
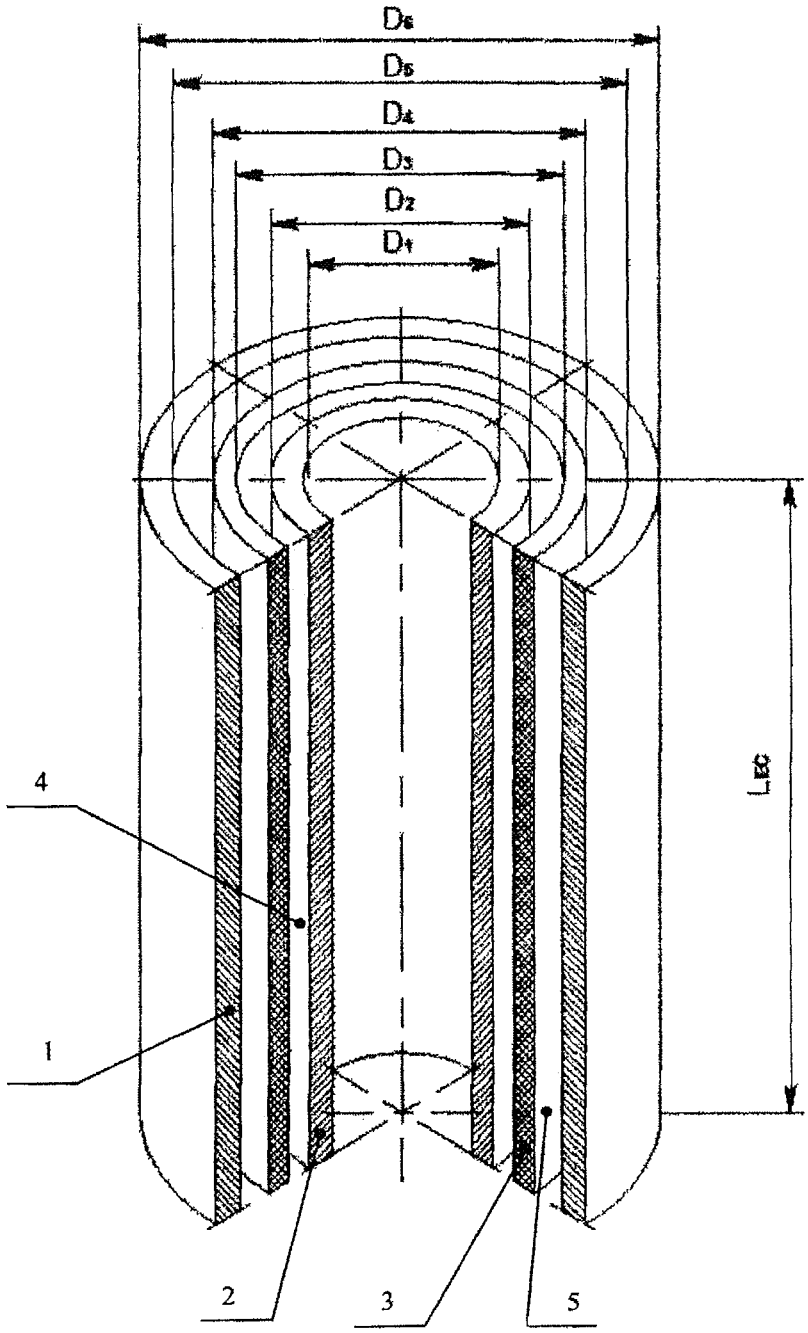
FIG. 1 is a cross-sectional view of the working section of the electrochemical cell, where: $D_1$ and $D_2$ are the inside and outside diameters, respectively, of the anode made of a titanium tube comprising a coating of rare metals applied on the developed outer surface thereof; $D_3$ and $D_4$ are the inside and outside diameters, respectively, of the ceramic permeable diaphragm; $D_5$ and $D_6$ are the inside and outside diameters, respectively, of the cathode made of a titanium tube, whose inner apparent (geometrical) surface is close to the active true (physical) surface; $L_{ec}$ is the length of the working section of the electrochemical cell.
Figure 2:
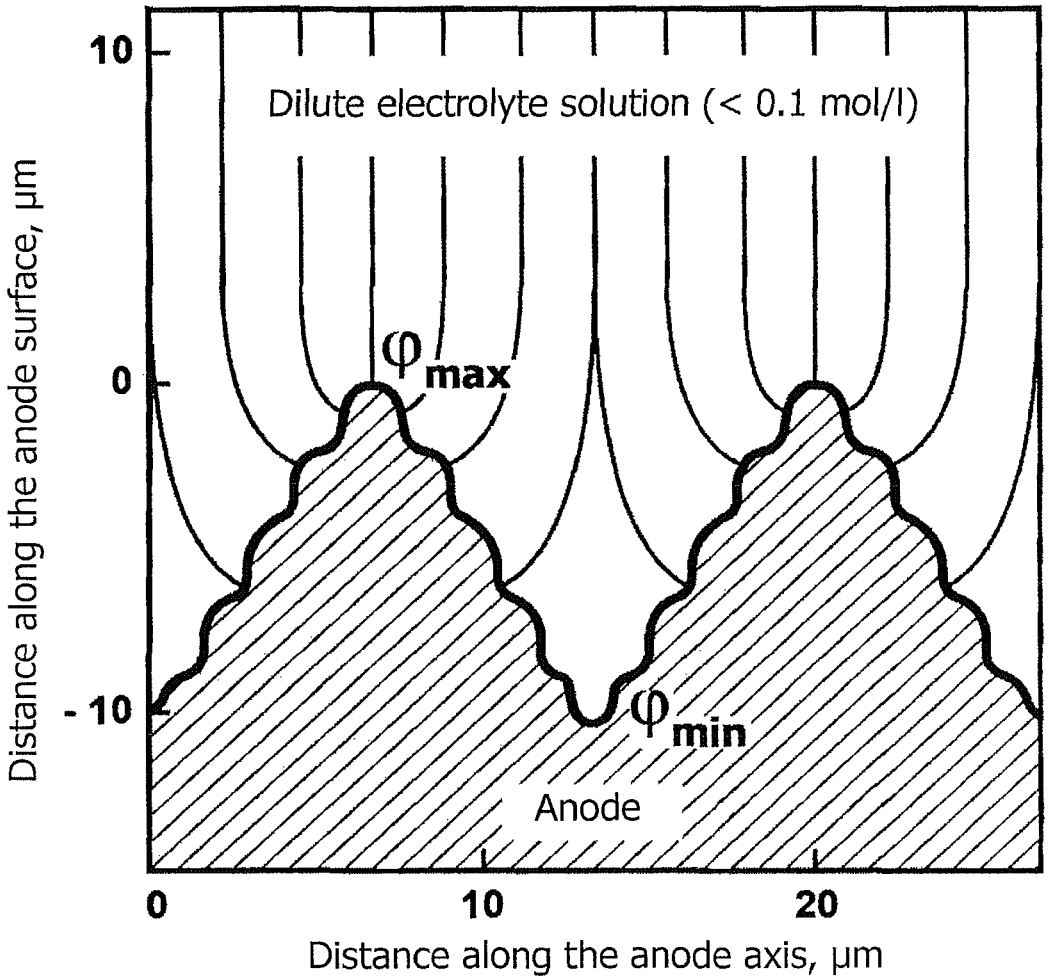
FIG. 2 is a schematic representation of the distribution of the current density and oxidation potential lines on the microrough anode surface in dilute solutions. For each type of the oxidation reaction there are optimum regions on the anode surface that has microgeometrical convexities and concavities; their sizes not exceeding 10 μm and the average difference between the maximum and minimum oxidation potentials on their surfaces being 0.2 to 0.3 V.
Figure 3:
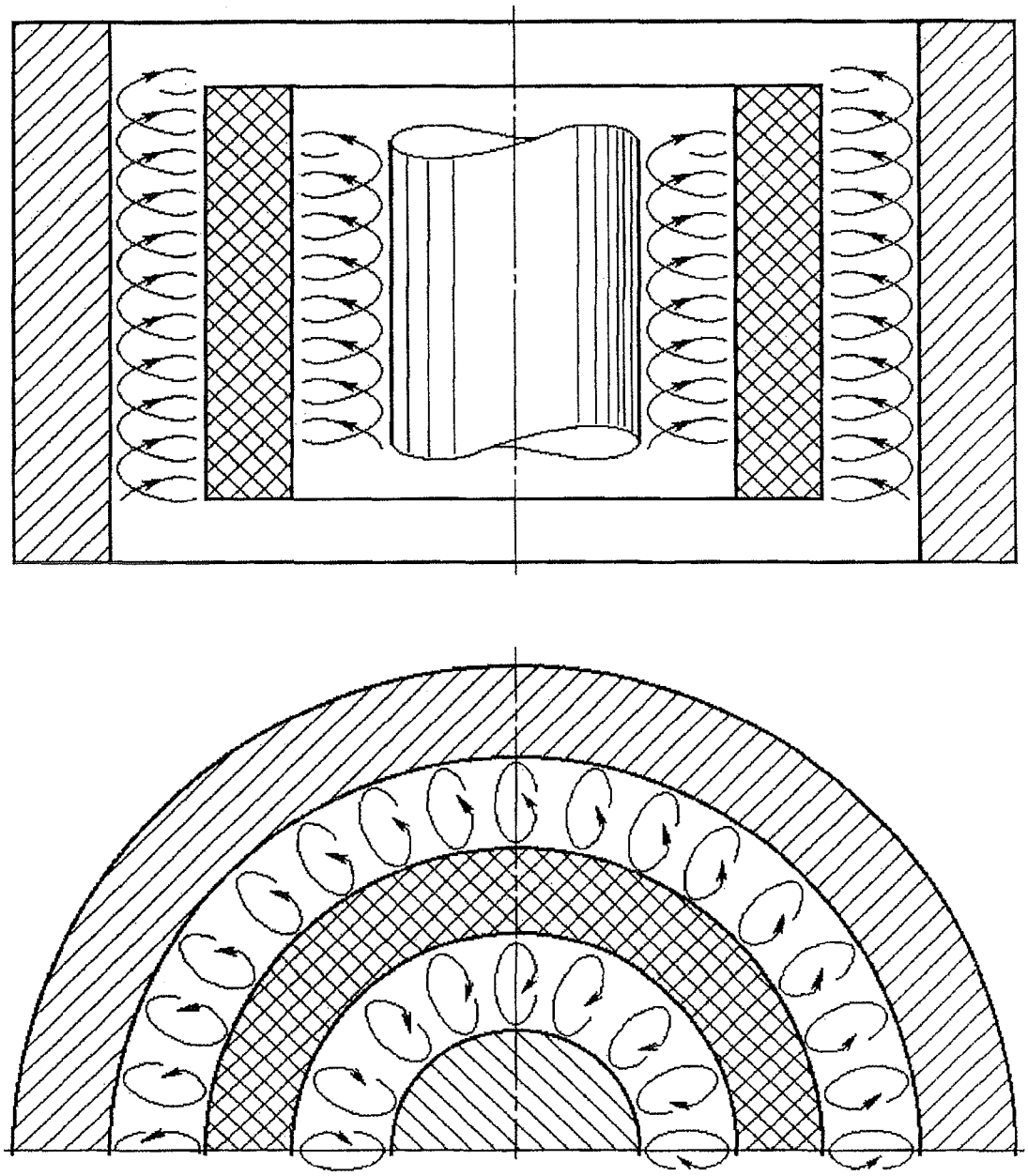
FIG. 3 is a schematic representation of the microtoroidal streams of solutions in the electrode chambers of the electrochemical cell. Each microlayer of the cross-cut working section of the cell represents the cathode and anode chemical reactors of ideal mixing.
Figure 4:
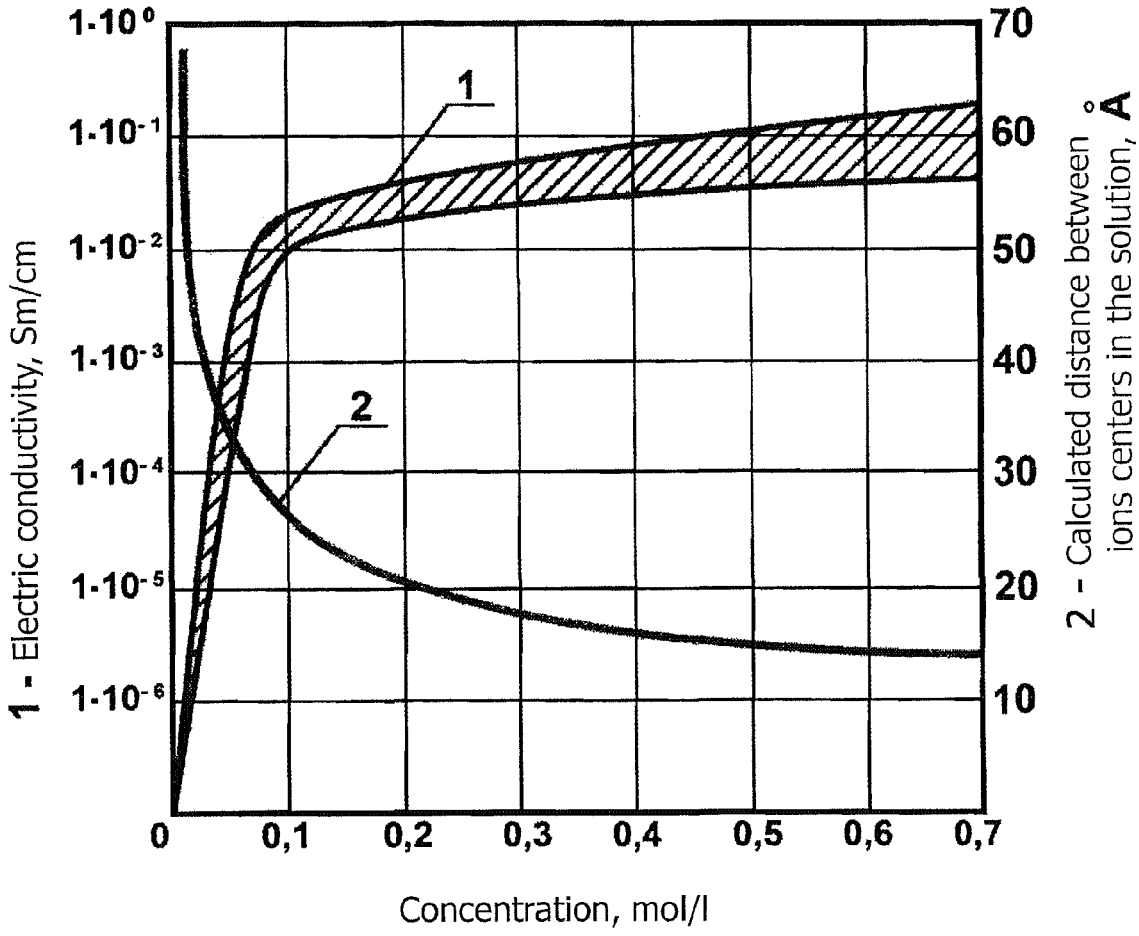
FIG. 4 is a graph of the electric conductivity of aqueous solutions of inorganic electrolytes (curve 1) and average spaces between the electrolyte ions as a function of concentration (curve 2). The electrolytes are inorganic acids, salts, and bases.
Figure 5:
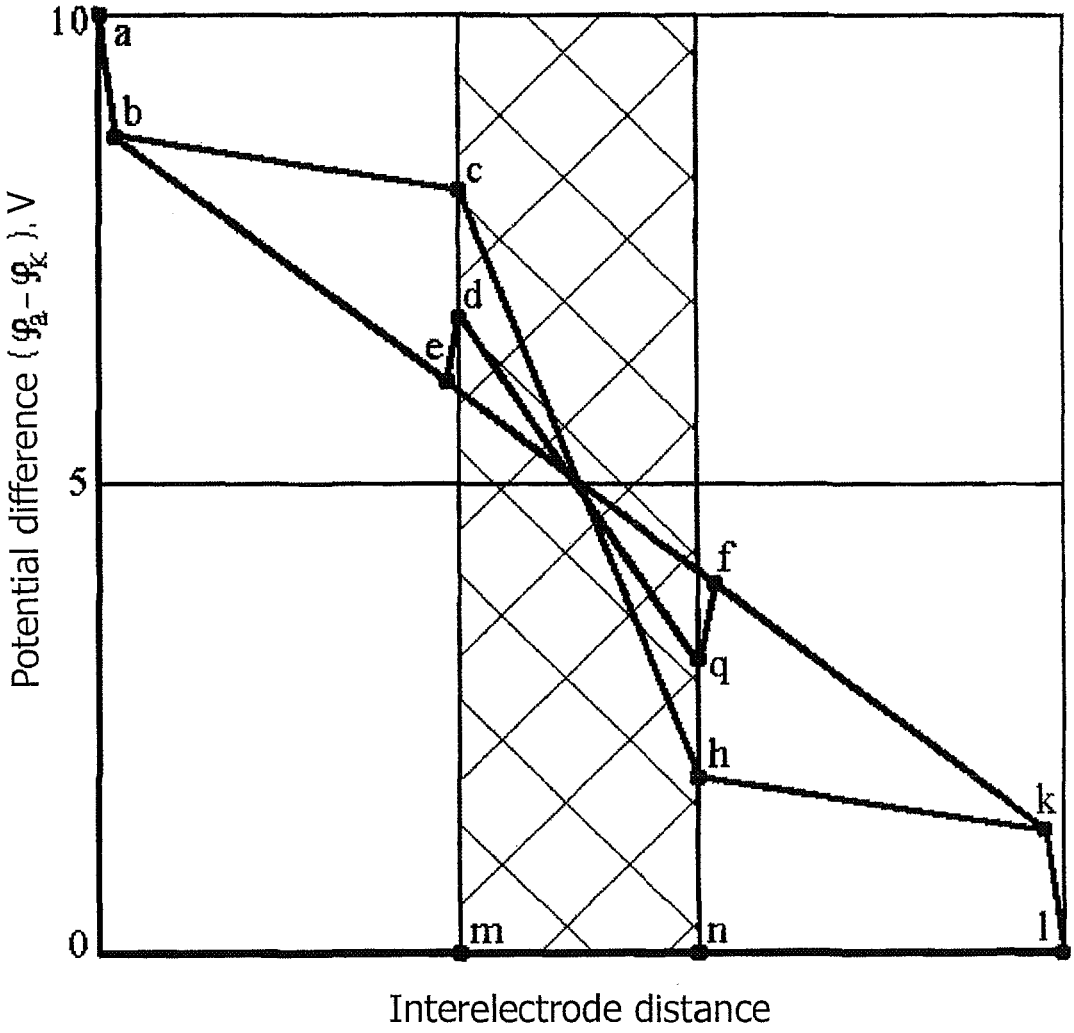
FIG. 5 is a graph of changes in the potential gradient in the interelectrode distance of the electrochemical cell (a, b, e, f, k, l) without a diaphragm, (a, b, c, h, k, l) with a corundum ceramic diaphragm, (a, b, e, d, q, f, k, l) with a diaphragm made of alumina grains glazed with oxides of rare or rare-earth metals; 0-m is the width of the anode chamber; m-n is the diaphragm thickness; n−1 is the width of the cathode chamber.

The working section of the electrochemical cell (FIG. 1) comprises a cathode 1, a tubular anode 2, and a ceramic diaphragm 3 dividing the interelectrode space into anode 4 and cathode 5 chambers. The working section of the cell is characterized with the following dimensions: $D_1$ and $D_2$ are the inside and outside diameters, respectively, of the anode made of a titanium tube comprising a coating of rare metal oxides applied on the developed outer surface; $D_3$ and $D_4$ are the inside and outside diameters, respectively, of the ceramic permeable diaphragm; $D_5$ and $D_6$ are the inside and outside diameters, respectively, of the cathode made of a titanium tube, whose inner apparent (geometrical) surface is close to the active true (physical) surface; $L_{ec}$ is the length of the working section of the electrochemical cell.

Figure 8:
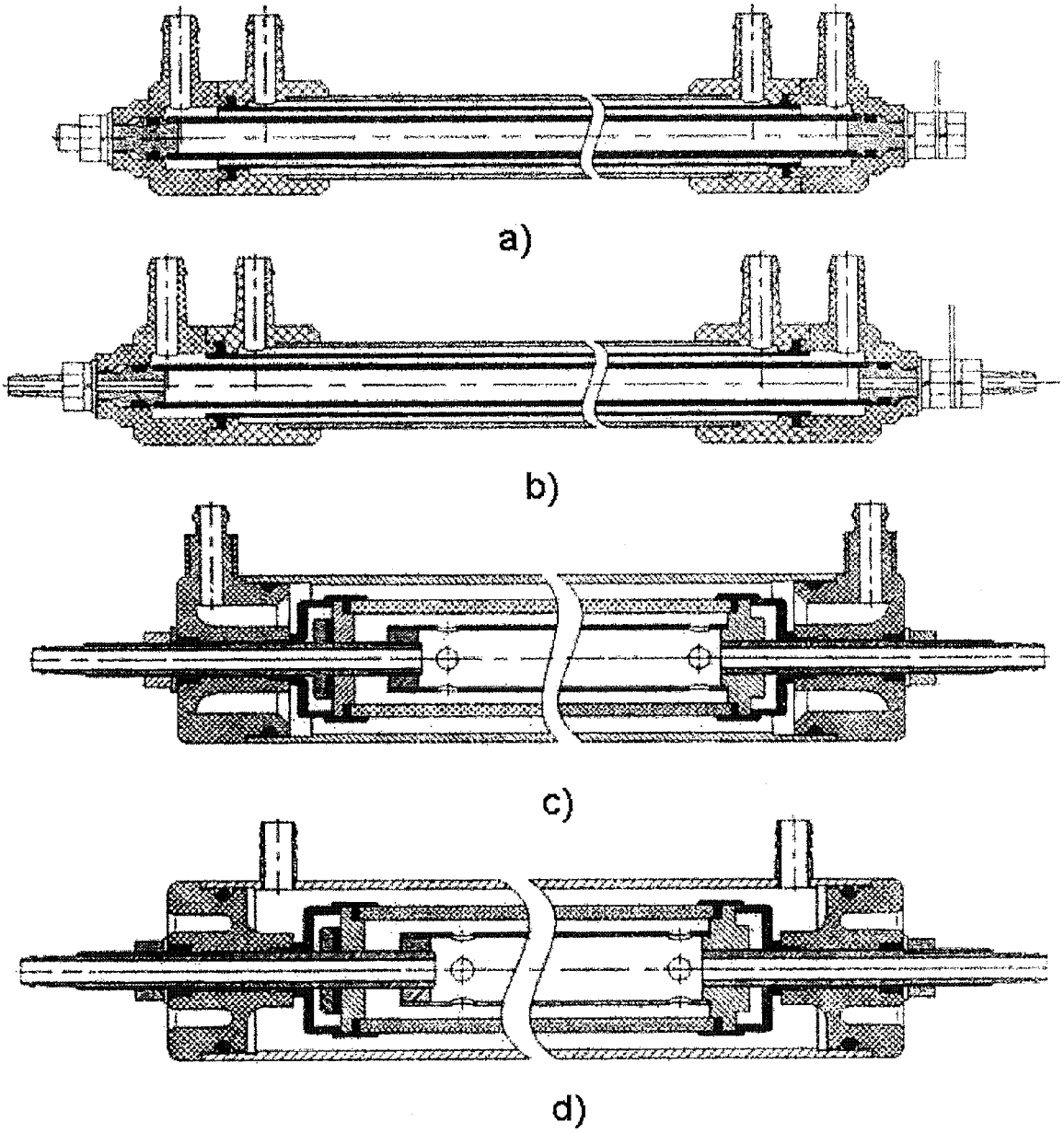
FIG. 8 is a schematic representation of embodiments of the units for mounting, securing, and sealing the electrodes and the diaphragm and devices for supplying and removing the electrolyte into and out of the electrode chambers.

FIG. 8 shows embodiments of the units for mounting, securing, and sealing the electrodes and the diaphragm and the devices for supplying and removing the electrolyte.

In the cell, the units for securing the electrodes and the diaphragm are made in the form of one or more parts made each of a dielectric material; the devices for supplying and removing the solutions into and out of the electrode chambers are made in the form of channels and sockets integrated with the unit parts. That embodiment is shown in FIG. 8*a*, wherein the units comprising each two parts, wherein sockets and channels communicating with one of the electrode chambers are located at the end sections of the cell. The units comprise also elastic packing for sealing the electrode chambers.

The units are made in the form of dielectric bushings located at the end sections of the electrochemical cell; at the ends of the bushings there are arranged grooves and the cell comprises dielectric commutating heads comprising an axial channel; the heads are arranged in the bushings grooves so that they can rotate; the diaphragm is secured in the bushings with the aid of the elastic packing located in the bushings grooves. The anode is secured in the heads with the aid of the elastic packing located in the axial channels of the heads; the heads and the bushings comprise corresponding channels for supplying and removing the processed water and/or a solution of the anode and cathode chambers, respectively. The channels are lead out to the side faces of bushings and heads and are equipped with connecting pipes.

The units being made in the form of bushings and heads comprising corresponding channels for supplying the electrolyte into the electrode chambers and removing the electrolyte from the electrode chamber, the inner, hollow electrode may be made in the aggregate with the inlet and outlet sockets communicating with its interior and located at the corresponding ends of the hollow anode (FIG. 8*b*). That design makes it possible to pass a heat-carrying agent through the hollow anode and to decrease thereby the cost of the electrochemical process due to removing the thermal agitation. The cell can be used for processing weak solutions, the production of disinfectant solutions of different chemical composition and of a low total salinity. The cell comprising a hollow anode for passing a heat carrier may be used in a process of purifying water from nitrates.

In the cell, the units for securing the electrodes and the diaphragm may be made in the form of one or more parts made each of a dielectric material; the devices for supplying and removing the processed solutions the cathode chambers are made in the form of channels and sockets integrated with the unit parts. The devices for supplying and removing the processed solution of the anode chamber are made in the form of sockets located at the end sections of the anode, with the anode comprising apertures. That embodiment is shown in FIG. 8*c*, wherein the units are made in the form of three or four parts comprising dielectric bushings and a packing system. The inlet and outlet sockets of the cathode chamber are sealed in the axial apertures of the dielectric bushings and the corresponding inlet and outlet channels communicating with the cathode chambers are lead out to the surface of the bushings.

A cell characterized in the above flow chart may be used in the production of oxygen and hydrogen, as well as in the production of sulfuric acid and sodium hydroxide from, sulfate solutions.

The electrochemical cell for processing solutions may be made such that the units for securing the electrodes and the diaphragm are made in the form of one or more parts made each of a dielectric material and the devices for supplying and removing the processed solution of the cathode chambers are made in the form of apertures and sockets located at the end sections of the cathode. The devices for supplying and removing the processed solution of the anode chamber are made in the form of sockets connected with the hollow interior of the anode, with the anode end sections comprising apertures. Depending on the intended use, the anode body may comprise additional apertures located uniformly along the full length of the working section of the cell. That embodiment is shown in FIG. 8*d*. In that embodiment, the units for securing the electrodes and the diaphragm also comprise three or four parts each and a packing system. The inlet and outlet sockets of the anode chamber are made of an electroconductive material, located at the ends of the hollow anode and communicate with its hollow interior. The hollow anode comprises perforation. At the end sections of the cathode surface, there are apertures equipped with sockets that are inlets and outlets and communicate with the cathode chamber.

The cells of that type may be used in processing concentrated sodium chloride solutions, e.g., in the production of anodic oxidation products from solutions of chlorides of alkali metals.

All elements shown in FIG. 8 are mounted on the protruding sections of the anode equipped with means of fastening such as nuts and washers.

The characteristic dimensions and relation of the dimensions of elements of the working section of the electrochemical modular cell are depicted in Table 1.

TABLE 1

| Parameter | Formula/Ratio |
|---|---|
| Geometrical surface area of anode ($S_{ag}$) | $S_{ag} = \pi D_2 L_{ec}$ |
| Geometrical surface area of cathode ($S_{cg}$) | $S_{cg} = \pi D_5 L_{ec}$ |
| Relation of true (physical) surface areas of anode ($S_{af}$) and cathode ($S_{cf}$) | $S_{af}:S_{cf} \geq 1$ ($S_{af} \geq S_{cf}$) |
| Geometrical outer surface area of diaphragm ($S_{dcg}$) | $S_{dcg} = \pi D_4 L_{ec}$ |
| Relation of true (physical) surface area of cathode ($S_{cf}$) and true (physical) outer surface area of diaphragm ($S_{dcf}$) | $S_{cf}:S_{dcf} \geq 1$ ($S_{cf} \geq S_{dcf}$) |
| Geometrical inner surface area of diaphragm ($S_{dag}$) | $S_{dag} = \pi D_3 L_{ec}$ |
| Relation of true (physical) inner surface are of diaphragm ($S_{daf}$) and true (physical) surface areas of anode ($S_{af}$) | $S_{af}:S_{daf} > 1$ ($S_{af} > S_{daf}$) |
| Interelectrode distance (IED) | $IED = (D_5 - D_2):2$ |
| Cross-sectional area of the cathode chamber ($S_c$) | $S_c = 0.785\ (D_5^2 - D_4^2)$ |
| Cross-sectional area of the cathode chamber ($S_a$) | $S_a = 0.785\ (D_3^2 - D_2^2)$ |
| Cross-sectional area of the diaphragm ($S_d$) | $S_d = 0.785\ (D_4^2 - D_3^2)$ |
| Volume of the anode chamber ($V_a$) | $V_a = S_a L_{ec}$ |
| Volume of the athode chamber ($V_c$) | $V_c = S_c L_{ec}$ |

TABLE 1-continued

| Parameter | Formula/Ratio |
|---|---|
| Relation of the cross-sectional areas of the electrode chambers ($S_c$, $S_a$) and diaphragm ($S_d$) | $0.8 \leq S_c:(S_a + S_d) \leq 1.0$ |
| Relation between the interelectrode distance (IED), true surface areas of anode ($S_{af}$), cathode, ($S_{cf}$) and volumes of the anode ($V_a$) and cathode ($V_c$) electrode chambers | $3.9 \leq IED\ [(S_{af} + S_{cf}):(V_a + V_c)] \leq 4.1$ |
| Relation between the true (physical) surface ares of anode ($S_{af}$), cathode($S_{cf}$), and outer ($S_{dcf}$) and inner ($S_{daf}$) true(physical) surface areas of the diaphragm | $S_{af} \geq S_{cf} \geq S_{dcf} > S_{daf}$ |

The cell operation is as follows. A solution to be processed is supplied to the anode 4 and cathode 5 chambers of the cell through the devices for supplying an electrolyte solution (are not shown in FIG. 1). Depending on the chemism of the process, the movement of the electrolyte in the chambers is effectuated as a parallel flow: in an upward or downward direction, or as a counterflow. According to another embodiment of the invention, filling one of the electrode chambers takes place by way of electrofiltration through the diaphragm from the second chamber or by way of filtration due the pressure drop at the diaphragm. Having passed the electrode chambers, the electrolyte is removed from the cell through the devices for removing (are not shown in FIG. 1). The solution is being processed either by its single passing through the chambers 4 and 5 or, in accordance with the embodiment comprising the anode 2 having apertures, by a circulation of the solution in the anode chamber.

EMBODIMENTS OF THE INVENTION

The present invention is illustrated by the following examples, which do not cover all aspects of the invention. In the examples, depending on the specificity of the problem to be solved, there are used electrochemical cells, wherein the length of the working section is 180 to 300 mm, the interelectrode distance is 3 to 11 mm, and the thickness of the diaphragm is 0.7 to 2.8 mm. Table 2 shows the parameters of cells used in the examples of embodiment of the invention. In the examples, the number of a cell used in each particular case is referred to.

Dimensions of the working sections of the electrochemical modular cells used in the processes described in the examples are depicted in Table 2.

TABLE 2

| | The cell number | | | | |
|---|---|---|---|---|---|
| Parameter | 1 | 2 | 3 | 4 | 5 |
| $D_1$, mm | 14.0 | 10.5 | 9.5 | 7.7 | 6.0 |
| $D_2$ mm | 16.0 | 14.0 | 12.0 | 10.2 | 8.0 |
| $D_3$, mm | 23.0 | 19.5 | 16.0 | 12.5 | 9.5 |
| $D_4$, mm | 28.0 | 24.0 | 19.2 | 15.5 | 11.5 |
| $D_5$, mm | 36.0 | 30.0 | 24.0 | 18.7 | 14.0 |
| $D_6$, mm | 40.0 | 33.7 | 27.5 | 21.7 | 16.0 |
| $L_{ec}$, mm | 290.0 | 265.0 | 240.0 | 210.0 | 185.0 |
| IED, mm | 10.0 | 8.0 | 6.0 | 4.2 | 3.0 |
| $S_c$, $mm^2$ | 402 | 254 | 163 | 86 | 50 |
| $S_a$, $mm^2$ | 214 | 97 | 88 | 41 | 20.6 |
| $S_d$, $mm^2$ | 200 | 153 | 88 | 66 | 33 |
| $V_a$, $mm^3$ | 62060 | 25705 | 21120 | 8610 | 3811 |
| $V_c$, $mm^3$ | 116580 | 67310 | 39120 | 18060 | 9259 |
| $S_c:(S_a + S_d)$ | 0.97 | 1.0 | 0.93 | 0.8 | 0.93 |
| IED $[(S_{af} + S_{cf}):(V_a + V_c)]$ | 3.91 | 4.05 | 3.95 | 4.08 | 3.93 |

EXAMPLE 1

Figure 9:
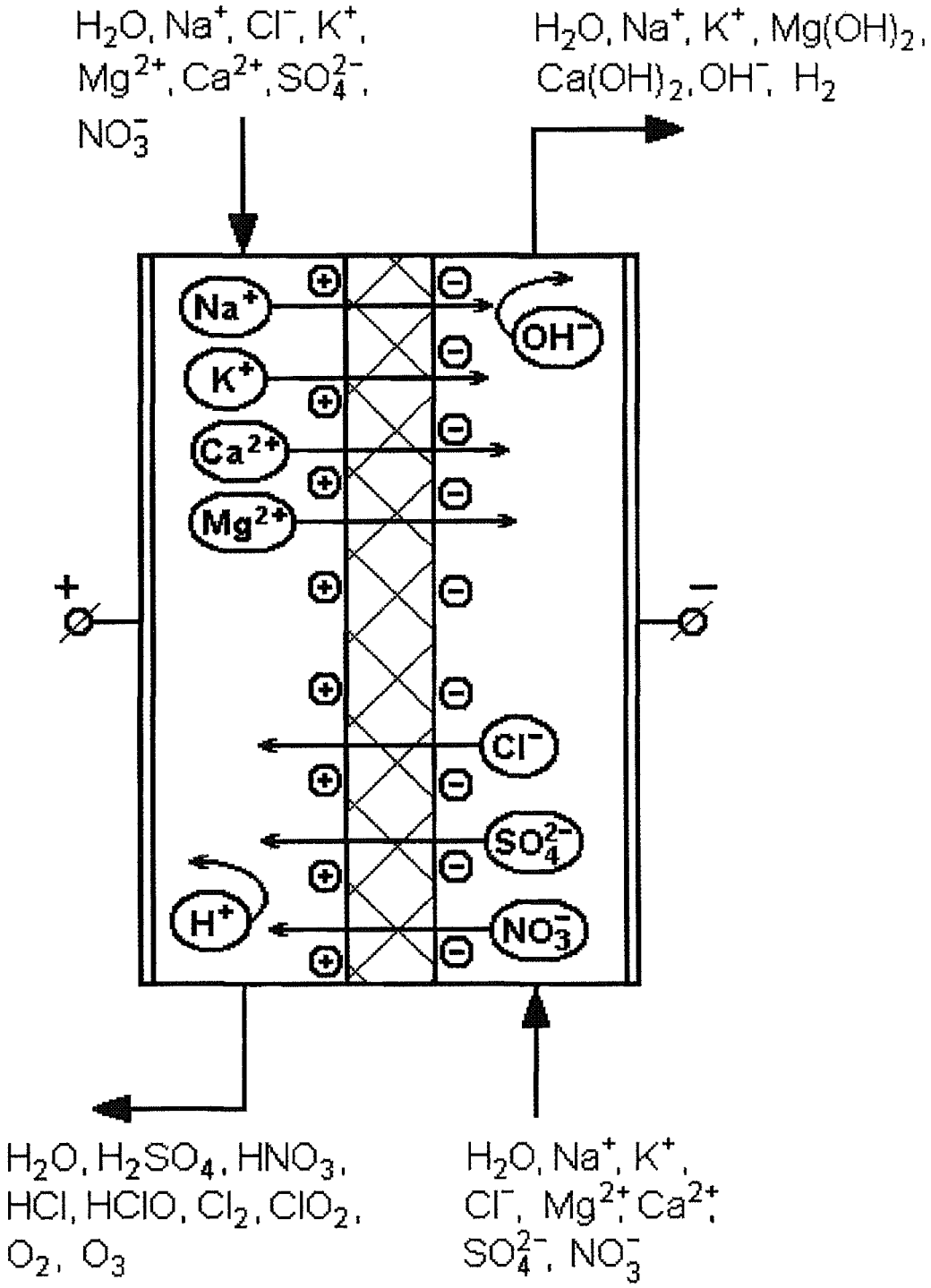
FIG. 9 is a schematic representation of the production of electrochemically activated anolyte and catholyte of fresh drinking water.

Production of Electrochemically Activated Anolyte and Catholyte from Fresh Water The electrochemical cell No. 5 comprising a non-cooled anode (Table 2 and FIG. 8*a*) was used. Drinking tap water having the total mineralization of 0.22 g/l and the initial pH=7.1 and ϕ=+280 mV (CSE) was subjected to the anode and cathode treatment in the said electrochemical modular cell. In production of the anolyte in accordance with the scheme shown in FIG. 9, the pressure in the anode chamber was 0.7 to 0.8 $kGs/cm^2$ and exceeded the pressure in the cathode chamber by 0.3 to 0.4 $kGs/cm^2$. The anolyte volume flow ranged from 5 to 6 l/h; the catholyte volume flow ranged from 10 to 12 l/h. In production of the catholyte, the pressure in the cathode chamber was 0.8 to 0.9 $kGs/cm^2$ and exceeded the pressure in the anode chamber by 0.3 to 0.4 $kGs/cm^2$. The catholyte volume flow ranged from 6 to 7 l/h; the anolyte volume flow ranged from 10 to 12 l/h. Altering the above hydraulic parameters was carried out by way of variable hydraulic resistances at the inlet of the electrode chambers of the cell and pressure regulators "to the full" at the outlet of the electrode chambers (are not shown in the scheme). The electric power intensity at the processing of water was about 1000 C/l).

Figure 10:
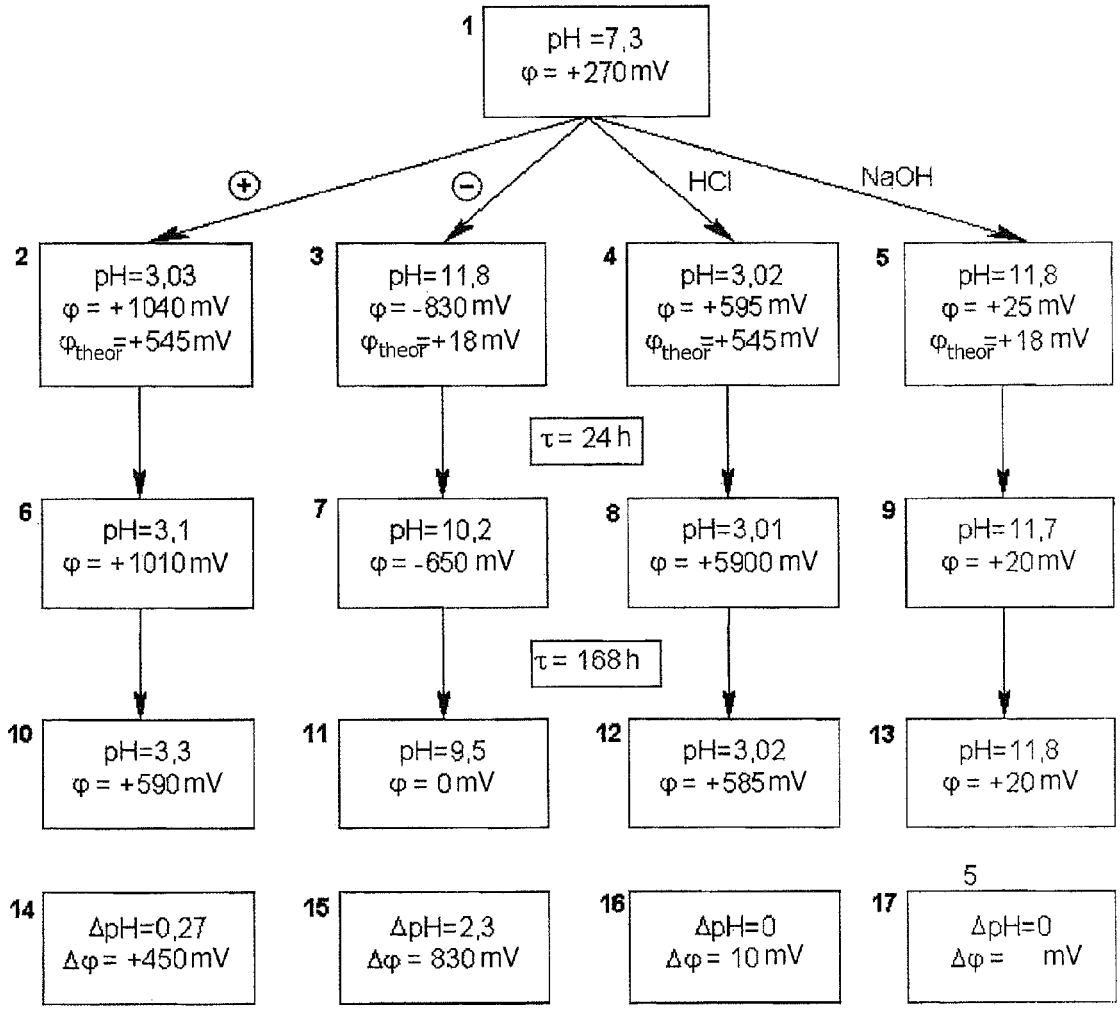
FIG. 10 is a scheme of experimental studies on time dependent changes in the parameters of electrochemically activated anolyte and catholyte of fresh drinking water as compared with model solutions.

The scheme of the experiment is shown in FIG. 10. Box No. 1 designates the samples of the initial drinking water whose parameters were subjected to chemical and electrochemical processing. The pH and redox properties (ϕ) of the anolyte and catholyte of the drinking water were measured immediately upon the production thereof (Boxes 2 and 3 in FIG. 10). An I-120 pH-and-millivoltmeter was used.

Usually, as a result of the cathode treatment, fresh or low-mineralized water acquires an alkaline reaction due to the conversion of part of salts dissolved therein into hydroxides. The redox potential of the water decreases drastically, the surface tension decreases, the content of dissolved oxygen and nitrogen decreases, the concentration of hydrogen and free radical groups increases, the electric conductivity decreases, and the structure not only of hydrate sheathes of ions, but also of the free volume of water changes.

As a result of the formation of highly soluble sodium and potassium hydroxides and, consequently, an increase in the pH value, there occurs a disturbance of the carbon-dioxide equilibrium with the formation of poorly soluble calcium and magnesium carbonates from soluble compounds of these metals (hydrocarbonates, chlorides, and sulfates) that are usually present in the initial water. Ions of heavy metals are converted into insoluble hydroxides.

As a result of the anode electrochemical treatment, the acidity of water increases, the redox potential increases due to the formation of stable and unstable acids (sulfuric, hydrochloric, hypochlorous, and persulfuric acids), hydrogen peroxide, peroxosulfates, peroxocarbonates, oxygen-containing compounds of chlorine, and different intermediate compounds formed in the course of the spontaneous decomposition and interaction of above substances. Also, as a result of the anode electrochemical treatment, the surface tension of water decreases, the electric conductivity decreases, the content of dissolved chlorine, oxygen decreases, the concentration of hydrogen and nitrogen decreases, and the structure of water changes.

A quantitative characteristic of the acidity or alkalinity of water is a hydrogen index pH, which is determined by the activity of hydrogen ions ($a_H$) or a relation of the concentration of hydronium ions $H_3O^+$ and a hydroxyl $OH^-$.

The redox potential (ϕ) is another important parameter which characterizes the activity of electrons in an aqueous solution (water). The parameter is measured with a high-resistance millivoltmeter and a pair of electrodes, of which one is a reference (auxiliary) electrode and the other is a measuring electrode. In practice, measurements are carried out with the use of a chlorine-silver electrode (CSE) as an auxiliary electrode and a platinum electrode as a measuring electrode. A platinum measuring electrode exchanges with a solution only electrons that are outside "the electrode-solution" boundary, i.e., it may be considered as an idealized reservoir with electrons. As that electrode is immersed into a solution (water), there takes place a contact between the two phases having a common particle, i.e., an electron; therefore, the condition of equilibrium for the electrode-solution boundary is characterized by the equality of electrochemical potentials of the electrons of the electrode and solution.

There is a relation between the redox potential and pH, which is expressed in practice in that a change in the drinking water pH by 1 pH unit upon addition thereto of sodium hydroxide or hydrochloric acid results in a change in the redox potential by approximately 59 mV, i.e., it increases as pH decreases and decreases as pH increases. It follows from the dependence of the inert electrode potential (the oxidizing potential of the solution) on the activity of solvated electrons in the solution, defined in terms of the Nernst's fundamental law, that an increase in the oxidizing potential ϕ is accounted for by a decrease in the activity of electrons in the solution and vice versa, a decrease in ϕ is determined by an increase in the activity of electrons.

The redox potential nature is accounted for mainly by quantum-mechanical characteristics of atoms of an elementary electrochemical system ("electrode-solution"), the specificity of its electronic structure, which determines the ionic potentials of the elements. The electronic structures of atoms and ions determine also the character and energy of processes of hydration of ions.

In case of electrochemical unipolar treatment of water, the pH and resox potential values of the catholyte and anolyte of drinking water are far beyond not only the scope of chemical control but also the scope of thermodynamic stability of water bounded with the potentials of the hydrogen and oxygen electrodes: $\phi H_{2(NHE)}=-0.059$ pH and $\phi O_{2(NHE)}=1.23-0.059$ pH, where NHE is a reference normal hydrogen electrode. The lower the water mineralization, the more difficult it is to achieve the maximum possible pH and redox potential values of the catholyte and anolyte. The key role belongs to the design and electrochemical properties of the reactor and the character of electrochemical processing itself. The comparative experimental studies on the results of the electrochemical activation of drinking water and data of chemical monitoring of the water are described below.

The initial tap water was added with hydrochloric acid and sodium hydroxide so that to provide analogs (in pH values) of the anolyte and catholyte (Samples 4 and 5, FIG. 10). There were performed measurements of pH and ϕ values of the chemical analogs and the ϕ values corresponding to the measured pH of all samples were calculated in terms of the Nernst's equation. These data are provided for samples 2-5 as $\phi_{theor}$. The measurements of pH and ϕ for all the four samples were repeated 24 and 168 hours after storage (boxes Nos. 6-9 and 10-13, respectively). An analysis of the experimental results for each sample under study is illustrated by the scheme (boxes Nos. 14-17). The data are represented graphically in FIG. 11 in the pH-ϕ coordinate system as trajectories of changes in the water parameters during the chemical and electrochemical monitoring bounded between the lower and upper boundaries of the thermodynamic stability of water, i.e., potentials of the hydrogen and oxygen electrodes.

Figure 11:
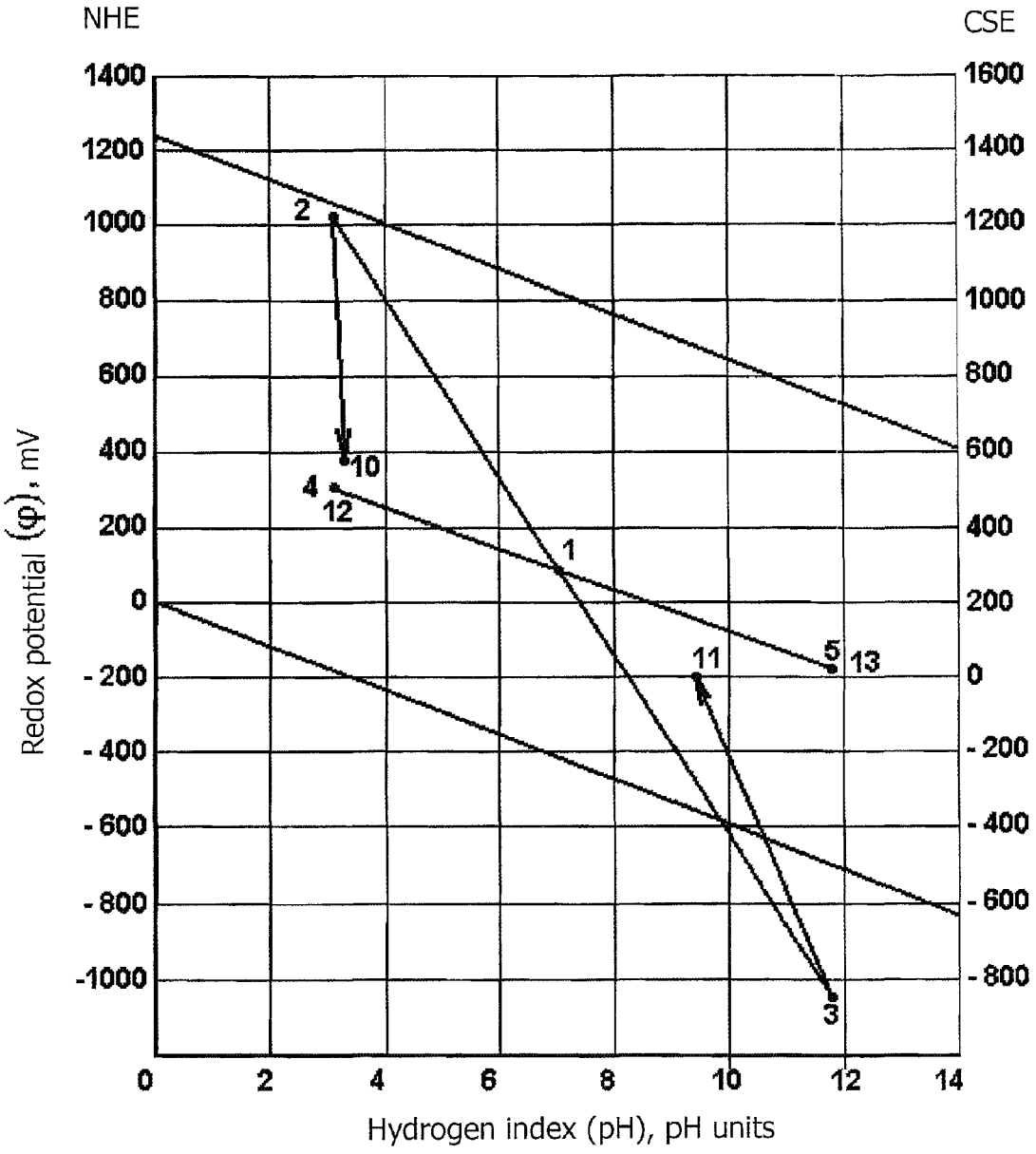
FIG. 11 is a comparative graph of pH and redox potential values of drinking water on the chemical and electrochemical processing and time-dependent changes in these values.

In FIG. 11, the point numbers on the lines correspond to the box numbers on the scheme in FIG. 10. As is evident from the represented data, there take place considerable relaxation changes in pH and ϕ for the anolyte and catholyte; whereas no such changes take place for their chemical models. For the chemical models of the anolyte and catholyte (numbers 4 and 5, FIGS. 10 and 11), there is observed an almost complete agreement between the measured and calculated ϕ values. For the activated anolyte and catholyte (numbers 2 and 3), the difference is more than 700 mV.

Also, another possibility of changes in p of the chemical models of the anolyte and catholyte was studied with the aim of obtaining the same values as those for water after the electrochemical processing. For that purpose, bubbling oxygen was passed through the water added with hydrochloric acid (4) at a ratio of 100 l of gas per 1 l of water. The redox potential was increased thereby by 100 mV, i.e., to +690 mV. Passing bubbling hydrogen through the water added with sodium chloride at the same ratio (100 l of gas per 1 l of water) (5) made it possible to decrease ϕ to −300 mV., i.e., by 320 mV. Thus, it was not possible to achieve the same pH and ϕ parameters as those that were achieved by the electrochemical processing.

It is remarkable that an increase in the mineralization of the initial water results in decreasing the relaxation changes in the pH and ϕ parameters. The relaxation processes manifest themselves most drastically in the electrochemical processing of water having the mineralization from 0.1 to 1 g/l.

In accordance with the classical thermodynamic definition, relaxation is a gradual transition of a system (a certain volume of water or an aqueous electrolyte solution) from a non-equilibrium state caused by an external action into the state of thermodynamic equilibrium. Relaxation is an irreversible process and, in accordance with the law of increasing entropy, it is accompanied by the conversion of part of the internal energy into heat, i.e., dissipation of the energy. Like any non-equilibrium effect, relaxation is not determined solely by thermodynamic parameters (e.g., pressure and temperature) but depends significantly on microscopic parameters, in particular, on the parameters characterizing the interaction between particles. The equilibrium is established usually in two stages. At the first stage, the equilibrium is established in separate microvolumes of water or a solution. At the second stage, there take place slow relaxation processes, which result in that the physical and chemical parameters achieve the stationary values determined by the conditions of the equilibrium with the ambient medium. These slow processes are associated with a great number of successive collisions of particles with each other. The time of relaxation thereof is proportional to the system size (the volume of the chemically activated water). Those slow relaxation processes involve such effects as viscosity, diffusion, heat conductivity, electric conductivity, catalytic activity, oxidation-reduction equilibrium, pH, surface tension, etc. The character of a rapid relaxation is determined by microscopic details of the interaction between particles. The interaction specificity may result in that the establishment of the equilibrium of any microscopic parameters will be strongly retarded as compared with similar processes involving other parameters. The relaxation rate is determined by the time during which the system characteristic alters e times as compared with the initial value thereof.

The rate and value of the relaxation changes in any parameters is usually so much the higher, the more effective the process of electrochemical activation, i.e., the less time is spent for the electrochemical treatment, the less energy is spent for the calorification, the more energy is spent for the physicochemical conversion of water, the larger amount of the water microvolumes being in contact with the double electric layer (DEL) during the electrochemical treatment, wherein the electric field intensity reaches several millions of volts per centimeter, and the higher the degree of unipolarity of the effect, i.e., the lower the intensity of penetration into the electrode space of electrochemically active particles from the electrode space of the electrode of the opposite sign charge.

EXAMPLE 2

Inversion of Sugar Syrup into Glucose-Fructose Syrup

The electrochemical modular cell No. 5 comprising a cooled anode (Table 2) was used. The relation of the physical surface areas of the anode and cathode $S_{af}:S_{cf}$) was 1.02.

The inversion of sugar syrup into glucose-fructose syrup is carried out with the aim of saving 20 to 30% of sugar used in the confectionary industry and in the production of soft drinks, juices, and ice-cream. The products containing glucose-fructose syrup instead of sugar syrup are useful for health of people suffering from diabetes and have a longer shelf life without loss of freshness. One of the most commonly used method of inversion is the acidification of sugar syrup with an inorganic acid, e.g., hydrochloric acid, to pH=2.0 to 2.5 with subsequent heating and allowing to stand at an elevated temperature. The reaction of inversion of saccharose is bimolecular; it involves one sugar molecule and one water molecule. In aqueous solutions of saccharose, the amount of water changes but slightly during the reaction, since only an insignificant part thereof enters the reaction. In the course of the reaction of inversion proceeding at an elevated temperature (about 75° C.) for 30 to 40 min, the amount of saccharose decreases, as a result of the irreversible conversion thereof into glucose and fructose. After the end of the reaction, the syrup is added with a neutralizing agent, e.g., sodium hydroxide, to achieve pH values close to the neutral ones. Then, the syrup is filtered so that to remove colloidal suspensions; however, it is impossible to remove a salt formed as a result of using chemical agents.

The electrochemical method of controlling pH makes it possible to carry out the inversion of sugar syrup without the use chemical agents.

The process is carried out as follows.

A sugar syrup having a concentration of 67% was supplied from a 5 l vessel into the anode chamber of the cell with the use of a peristaltic pump at a rate of 1.0 l/h. Through the cathode chamber of the cell engaged into the flow circuit comprising a 1 l vessel with a similar syrup and another peristaltic pump, the sugar syrup was pumped in a forward flow mode at a rate of 1.0 l/h. The anode of the cell was cooled with a running tap water flowing at a rate of 1.0 l/h. The current of 0.4 amperes and voltage of 100 volts was applied to the cell. The excess pressure of 0.5 kGs/cm$^2$ was created in the anode chamber over that in the cathode chamber, with the use of a pressure stabilizer mounted on a line of the syrup exit from the anode chamber. As the experiments showed, at that pressure drop, hydroxyl ions from the cathode chamber could not enter the anode chamber and thus reduced the efficiency of the electrochemical treatment. The pH values were measured at the inlet and outlet of the anode chamber. The pH values were 7.2 and 2.3, respectively. The syrup obtained after the anode treatment was heated in the vessel at a temperature of 75° C. for 20, 30, and 40 min. After cooling, the obtained syrup of a low pH value was passed through the cathode chamber with the use of a peristaltic pump at a rate of 0.7 l/h. The anode chamber of the cell was engaged into the flow circuit comprising a 1 l vessel with the cathode-treated syrup and another peristaltic pump, which passed an auxiliary volume of the syrup in a forward flow mode at a rate of 1.0 l/h. During the cathode treatment of the basic volume of the syrup, the pressure drop between the electrode chambers was maintained at the level of 0.6 kGs/cm$^2$ with the use of a pressure stabilizer mounted at the outlet of the cathode chamber. The pH value of the inverted solution after the cathode treatment was 5.6, which satisfies the requirements of the commercial production. A degree of inversion of sugar depending on the time of standing at an elevated temperature (20, 30, and 40 min) was 30, 55, and 80%, respectively.

For a cell wherein the relation of the physical surface area of the anode to the physical surface area of the cathode is less than unity, in particular, 0.57; pH of the syrup after the exit from the Anode chamber was 3.5. In that case, a degree of inversion of sugar depending on the time of standing at an elevated temperature (for 20, 30, and 40 min) was 15, 30, and 50%, respectively.

EXAMPLE 3

Deacidification of Milk

The electrochemical modular cell No. 4 (Table 2) was used.

Figure 12:
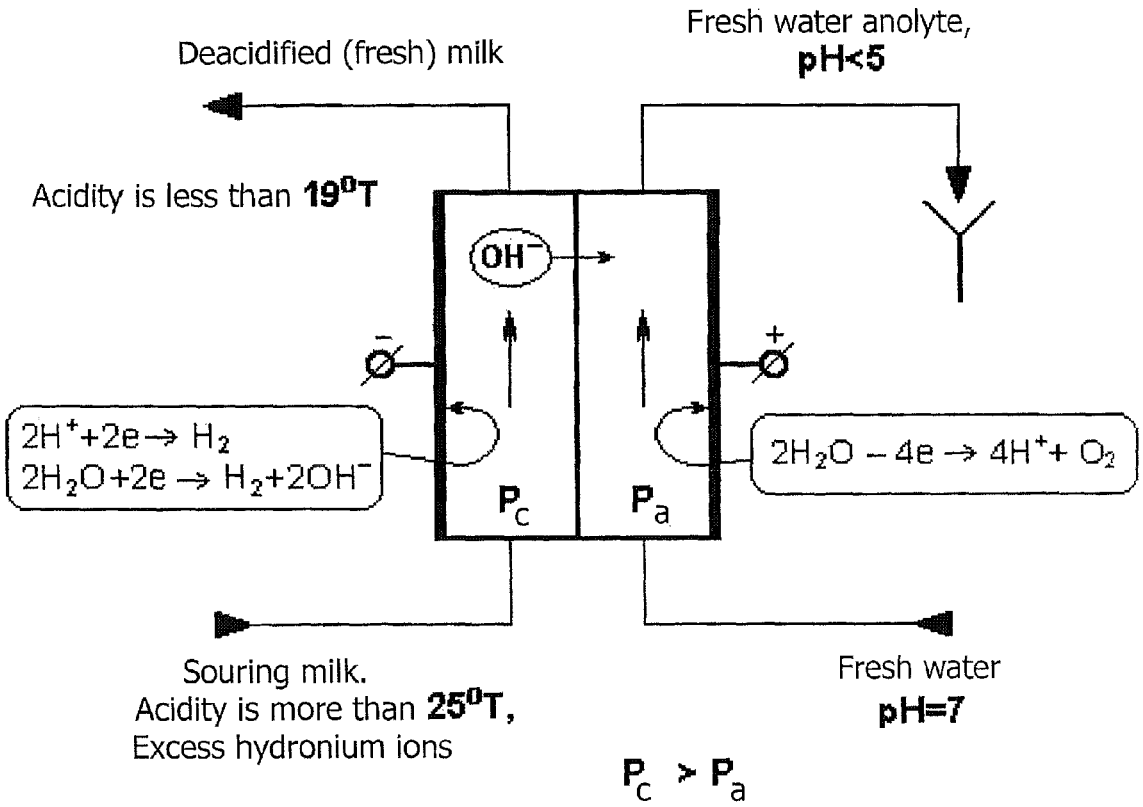
FIG. 12 a schematic representation of the electrochemical deacidification of milk.

One of the main factors that cause a rapid change in the properties and sensory quality of milk is acidity. The acidity of milk is accounted for by hydrogen ions formed as a result of the electrolytic dissociation of acids and acid salts comprised in milk. Hydrogen ions possess a high activity in breaking the casein-calcium-phosphate complex, releasing casein, clotting milk, and acting upon its saline component. As the acidity increases, the properties of milk as a food product and as a raw stuff for processing are gradually changing. In case of a quantitative estimation, the milk acidity is expressed in Turner degrees (° T). The acidity of the fresh milk is on average 16 to 18° T. The pH value of the fresh milk ranges from 6.3 to 6.8. The reproduction of lactobacilli in the milk results in appearance of lactic acid therein, which gradually takes away calcium from casein; pH of the milk decreases and the colloid system of the casein complex becomes less stable. The milk having the acidity higher than 22° T does not usually withstand boiling and curdles. In the commercial production, such milk can be used only for preparing curds. Deacidification of milk is a process of normalizing (reducing) the acidity thereof. It is possible to control the acidity of milk by adding an alkaline agent thereto, e.g., baking soda. However, the method of chemical control of the milk acidity leads inevitably to increasing the mineralization of the milk, and, consequently, to reducing its stability in boiling and loss of taste properties. With an electrochemical method, it is possible to control the milk acidity without the use of chemical agents. A schematic diagram of the process is shown in FIG. 12.

The test subjects were fresh and pasteurized cow's milk having a fat content of 3.2 wt % and acidity 28 and 32° T.

The milk was supplied from 5 l vessels to the cathode chamber of the cell at a rate of 5 l/h. Tap drinking water was passed through the anode chamber of the cell in the counterflow mode at a rate of 7 l/h. In the cathode chamber, an elevated pressure (0.7 kGs/cm$^2$) as compared with that in the anode chamber (equal to the atmospheric pressure) was created by means of a pressure stabilizer mounted at the outlet of the cathode chamber. The current of 2.8 A with a voltage of 25 volts was applied to the cell. Thereby, the milk acidity was reduced from 28° T to 16° T and from 32° T to 18° T.

An organoleptic evaluation of the deacidified milk showed the elimination of the defects of the sensory properties of milk upon the electrochemical processing.

EXAMPLE 4

Regeneration of Oxidized Fats

The electrochemical modular cell No. 3 (Table 2) was used.

A method of regeneration of oxidized fats is based on the cathodic reduction of fat oxidation products by passing the fat heated to 60 to 70° C. through the cathode chamber of an electrochemical reactor. In that case, a common drinking water heated to the same temperature as that of the fat is passed through the anode chamber of the electrochemical reactor. An indispensable condition of the process is a maximum contact for all microvolumes of the processed fat with the cathode surface and an elevated pressure in the cathode chamber as compared with the pressure in the anode chamber; the pressure drop at the diaphragm should not be less than 0.3 to 0.5 kGs/cm$^2$.

The molten cooking oil having the yellow-grey color and the acid number of 0.96 mg KOH/g and having a strong unpleasant smell and rancidity, heated to a temperature of 65° C. was supplied from a 10 l vessel by means of a peristaltic pump to the inlet of the cathode chamber of the vertically arranged cell at a rate of 3 l/h. Hot tap water heated to the temperature of about 70° C. was supplied in the forward flow mode to the inlet of the anode chamber located in the lower section of the cell at a rate of 4 l/h.

The pressure drop at the diaphragm was maintained at a level of 0.9 kGs/cm$^2$ by means of a pressure stabilizer mounted at the outlet of the cathode chamber.

An analysis of the oil after the electrochemical processing showed that its acid number has decreased to 0.35 mg KOH/g. The processed oil had the light-yellow color, a pleasant taste without smell; its stability at storage was 3 months at room temperature. Thus, it was shown that the cathode treatment of oil made it possible to restore the lost properties and decrease the oxidation characteristics thereof during storage.

EXAMPLE 5

Synthesis of Peroxocarbonate Disinfectant Solution

The electrochemical cell No. 5 (Table 2) was used for producing a peroxocarbonate solution.

The cell comprises coaxial cylindrical tubular electrodes and a 0.7 mm thick ceramic diaphragm separating the electrodes. The ceramics composition is as follows: 80% of alumina and 15% of modified zirconium dioxide. The modified zirconium dioxide comprises 5.0% of yttrium oxide. The electrodes were made of titanium having an iridium oxide coating (anode) and a pyrocarbonic coating (cathode). The length of the working section of the cell is 185 mm; the volume of the cathode chamber is 10 ml; the volume of the anode chamber is 7 ml.

The experimental setup operates in the following manner. Fresh water is supplied to the inlet of the cathode chamber at a rate of 3 l/h and exits to the drainage. The initial solution of an alkali metal carbonate having a concentration of 0.5 g/l is supplied to the inlet of the anode chamber in the counterflow mode by means of a dosing pump at a rate of 1 l/h. A pressure stabilizer is mounted at the outlet of the anode chamber in order to maintain the pressure drop 0.2 kGs/cm$^2$ on the diaphragm. The stabilized electric current of 2 A is applied to the cell; the voltage on the electrodes ranging from 25 to 30 volts. On the cathode, the reaction of reduction of water takes place:

$$2H_2O+2e \rightarrow H_2+2OH^-.$$

As the water advances in the cathode chamber, the concentration of sodium hydroxide therein increases as a result of the electromigration of sodium ions from the anode chamber to the cathode chamber through the diaphragm.

In the beginning of the flow of the sodium carbonate solution in the anode chamber, there take place the reactions of formation of sodium peroxocarbonate in conformity with the overall electrochemical reactions:

$$2Na_2CO_3 \rightarrow 10H_2O \rightarrow 2HOC(O)OOC(O)ONa+2NaOH+O_2+8H_2;$$

$$2Na_2CO_3+6H_2O \rightarrow 2HOC(O)OONa+2NaOH+4H_2+CO_2;$$

As the carbonate solution further advances in the anode chamber and the medium pH decreases, it is depleted of sodium ions; the carbonates are converted into hydrocarbonates that are also subjected to oxidation in conformity with the following overall reactions:

$$2NaHCO_3+2H_2O \rightarrow HOC(O)OOC(O)ONa+NaOH+2H_2+\tfrac{1}{2}O_2;$$

$$2NaHCO_3+H_2O \rightarrow HOC(O)OONa+NaOH+H_2+CO_2.$$

As pH in the anode chamber decreases and approaches to pH=7, the next stage of the anodic oxidation of sodium peroxocarbonate solutions is the conversion of peroxocarbonate salts into the corresponding acids: percarbonic acid (HOC(O)OOC(O)OH) and monopercarbonic acid (HOC(O)OOH):

$$HOC(O)OOC(O)ONa+H_2O \rightarrow HOC(O)OOC(O)OH+NaOH;$$

$$HOC(O)OONa+H_2O \rightarrow HOC(O)OOH+NaOH.$$

The obtained solution (the anolyte "Perox" have the following characteristics: the content of monopercarbonic acid and percarbonic acid is 20 to 50 mg/l; the redox potential is from +500 to 8000 mV with regard to a chlorine-silver reference electrode.

EXAMPLE 6

Synthesis of a Low-Mineralized Disinfectant Solution (the Neutral Anolyte AN) Having a High Content of Chlorine-Oxygen and Hydroperoxide Oxidants The electrochemical cell No. 5 (Table 2) was used for the synthesis of a low-mineralized disinfectant solution having a high content of oxidants.

Drinking water was supplied to the anode chamber of the cell at a rate of 3 l/h. The total mineral content of the water was 0.15 g/l. A pressure stabilizer mounted at the outlet of the anode chamber maintained the constant pressure 1.2 kGs/cm$^2$ in the anode chamber. The inlet and outlet of the cathode chamber were connected via flexible hoses to a 0.2 l circulation vessel filled with drinking water and mounted 10 cm higher than the vertically arranged cell. As the voltage of 40 volts is applied to the cell from a stabilized dc source, the current increases gradually from the initial 0.8 A to 3 A. Thus, a circulation of the catholyte takes place in the cathode chamber of the cell due to a gas lift accounted for by the releasing hydrogen. The content of oxidants in the water obtained upon the anodic treatment in the cell and measured with a titrimetric technique was 50 mg/l.

In case of using the cell No. 5, wherein the relation of the physical surface area of the anode to the physical surface area of the cathode is 0.63, the content of oxidants in the water after the anodic treatment in the cell and measured with a titrimetric technique was 24 mg/l.

EXAMPLE 7

Purification of Water from Anion-Active Surfactants

The electrochemical cell No. 3 (Table 2) comprising a cooled anode was used for removing of anion-active surfactants (AAS) from water. The water, of which the volume in a vessel was 9 l, was pumped in the circulation mode through the anode chamber of the cell with a peristaltic pump at a rate of 12 l/h. An auxiliary electrolyte solution, of which the volume in vessel was 1 l, was pumped in the circulation mode through the cathode chamber of the cell with a peristaltic pump at a rate of 15 l/h. A flow of cooling water was passed through the anode cavity at a rate of 5 l/h.

Upon establishing the circulation mode, a direct voltage was applied to the cell electrodes from a stabilized source.

The circulating anolyte was analyzed at regular intervals for the AAS content with the aid of a methylene blue. From the analyses results, there were calculated the values for a degree of removal of AAS from the solution, the specific charge (Qe), and the specific energy consumption (We) required for removing (decomposition) of 1 g of AAS in accordance with the formulas:

$Qe=I^xT/m$; $We=^{xI}xT/m$; wherein m is the mass of the decomposed substance, g; I is the current strength, A; U is the voltage, V; T is the time of the process, h.

During the experiment, constant levels of the solutions in the vessels of the circulating water and the catholyte were maintained by varying the rates of circulation of the solutions and with the aid of the pressure stabilizers mounted at the outlet of the electrode chambers.

The water to be purified (anolyte) was a model solution prepared by adding a synthetic detergent ("Lotos-avtomat") to tap water from the river Moscow to reach the AAS and sodium chloride concentrations 50 mg/l and 1.5 g/l, respectively. A 1.0 mol/l solution of sodium hydroxide was used as a catholyte. During the whole process, the pH value of the circulating anolyte was maintained at the level of 6 to 8 by adding a 6 M solution of sodium hydroxide. The experiment was carried out at a constant strength of the current equal to 16 A; the voltage at the electrodes was 9.0 to 9.5 V. The results of removing AAS from a model solution are depicted in Table 3.

TABLE 3

The values of a degree of AAS removal from a model solution, the specific charge (Qe), and the specific energy consumption (We).

| | Duration of process, h | | | | | |
|---|---|---|---|---|---|---|
| | 0 | 1 | 2 | 7 | 9 | 11 |
| AAS concentration, mg/l | 50.0 | 23.8 | 17.6 | 6.9 | 3.3 | 2.1 |
| AAS removal degree, % | 0 | 52.4 | 64.8 | 86.2 | 93.4 | 95.8 |
| Qe, A × h/g | 0 | 244 | 395 | 1039 | 1233 | 1470 |
| We, W × h/g | 0 | 2321 | 3753 | 9875 | 11717 | 13962 |

The data in the table show that AAS can be removed almost completely from 9 l of the model solution during 11 hours. As the AAS concentration decreases, the values of the specific charge (Qe) and the specific energy consumption (We) required for the removal of 1 g of AAS increase progressively and are equal to 244 A×h/g and 2321 W×h/g, respectively, at the beginning of the process and 1470 A×h/g and 13960 W×h/g, respectively, at the end of the process.

Thus, the experiments performed showed up the feasibility of using the electrochemical process for removing AAS from solutions. Similar results were obtained with the use of a unit consisting of 8 cells No. 5 (Table 2) comprising anodes non-cooled during the process; the strength of current flowing through each cell was 2 A.

EXAMPLE 8

Purification of Water from Nitrates

The electrochemical cell No. 2 (Table 2) was used for purification of water from nitrates.

The tests were carried out on a laboratory setup consisting of a cell, a dc source that permitted control of and maintaining the voltage and strength of current ranging from 0 to 30 volts and 0 to 3 amperes, respectively, a peristaltic pump, and vessels for circulating the anolyte and catholyte.

The test procedure was as follows: water containing dissolved nitrates was pumped in the circulation mode first through the cathode chamber of the cell and then through the anode chamber in the counterflow mode. The circulating water was analyzed at regular intervals for the ammonia content with a spectrophometric technique using a Nessler reagent.

The water to be purified was a model solution prepared by adding an ammonia sulfate solution to tap water to reach a concentration of ammonia ions of 145 to 185 mg/l; pH=7.6 to 7.8. In some cases, sodium chloride was added in an amount of 1 to 3 g/l. From the analyses results, there were calculated the values for a degree of removal of ammonia from the water, the specific charge (Qe), the specific energy consumption (We) required for removing (decomposition) of 1 g of ammonia, and the current yield (CY) in accordance with the formulas:

$Qe=I^xT/m$; $We=U^{xI}xT/m$; $CY=m^xF/(I^xT^xE)$ $^x100\%$, wherein m is the mass of decomposed substance, g; I is the current strength, A; U is the voltage, V; T is the time of the process, h; F is the Faraday constant ($F=26.8A^xh$; E is the electrochemical equivalent (E for ammonia is 5.7 g).

The chemical process of purification of water from nitrates is as follows. In the electrochemical cell, an overall reaction of decomposition of sodium chloride takes place, which is accompanied by the liberation of molecular chlorine in the anode chamber and formation of sodium chloride in the cathode chamber:

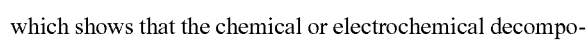

$$2NaCl+2H_2O-2e \rightarrow 2NaOH+H_2+Cl_2$$

The overall reaction of removal of ammonia in the anode chamber is described by the following equation:

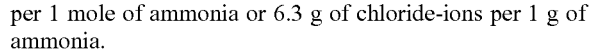

$$2NH_3+3Cl_2+6NaOH = N_2+6H_2O+6NaCl,$$

which shows that the chemical or electrochemical decomposition of ammonia by the product gaseous chlorine yields the equal number of resulting chloride-ions: 3 g-ion of chloride per 1 mole of ammonia or 6.3 g of chloride-ions per 1 g of ammonia.

An advantage of the electrochemical processing of ammonia-containing solutions, especially those having a high concentration of ammonia, is the possibility of complete decomposition of ammonia by adding a relatively small amounts of chloride-ions (1 to 2 g/l) that play the role of carriers of electrons and are not consumed during the reaction.

The experiment was conducted with a simultaneous circulation of the purified solution successively through the cathode and anode chambers. The volume of the solution was 3.8 l; the circulation rate, 30 l/h. During the experiment, the constant strength of the current (2.5 A) was maintained; the voltage applied to the cell was 20 to 22 V. The pH value was maintained in a range of 6 to 8. The obtained results are depicted in Table 4.

TABLE 4

The values for a degree of removal of ammonia, the specific charge (Qe), the specific energy consumption (We), and the current yield (CY).

| | Duration of process, h | | | | | |
|---|---|---|---|---|---|---|
| | 0 | 1 | 2 | 3 | 4 | 5 |
| Ammonia concentration, mg/l | 184 | 174 | 169 | 151 | 149 | 136 |
| Ammonia removal degree, % | 0 | 5.4 | 8.2 | 17.9 | 19.0 | 26.1 |
| Qe, A × h/g | 0 | 66 | 88 | 60 | 75 | 68 |
| We, W × h/g | 0 | 1428 | 1850 | 1244 | 1571 | 1398 |
| CY, % | 0 | 6.8 | 5.1 | 7.5 | 5.9 | 6.5 |

The data in the table show that only 26% of ammonia is removed the solution during 5 hours; the energy spent for the decomposition of ammonia is high, and the CY value does not exceed 7.5%, as a result of a low efficiency of the oxidation of ammonia by the anode products of the electrolysis (the atomic and gaseous oxygen, hydrogen peroxide, and others). Therefore, the other experiments were performed with the addition of sodium chloride to the solution during the purification.

The next experiment was performed by analogy with the preceding one, with the exception that sodium chloride was added to the initial solution in an amount of 1 g/l. The volume of the solution was 3.8 l, the circulation rate being 30 l/h. During the experiment; the constant strength of the current (3.0 A) was maintained; the voltage applied to the cell was about 10 V. The pH value was maintained in a range of 6 to 8. The obtained results are depicted in Table 5.

TABLE 5

The values for a degree of removal of ammonia, the specific charge (Qe), the specific energy consumption (We), and the current yield (CY).

| | Duration of process, h | | | | | | | |
|---|---|---|---|---|---|---|---|---|
| | 0 | 1 | 2 | 3 | 4 | 5 | 6 | 7 |
| Ammonia concentration, mg/l | 155 | 133 | 107 | 88 | 70 | 23 | 3.0 | 0 |
| Ammonia removal degree, % | 0 | 14.2 | 31.0 | 43.2 | 54.8 | 85.2 | 98.1 | 100 |
| Qe, A × h/g/Γ | 0 | 36 | 33 | 35 | 37 | 30 | 31 | 36 |
| We, W × h/g | 0 | 502 | 362 | 354 | 372 | 299 | 312 | 312 |
| CY, % | 0 | 12.4 | 13.6 | 12.6 | 12.0 | 14.9 | 14.3 | 12.3 |

Further experiments were performed likewise, with the exception that sodium chloride was added to the initial solution in an amount of 3 g/l. The volume of the solution was 3.8 l, the circulation rate being 30 l/h. During the experiment, the constant strength of the current (3.0 A) was maintained; the voltage applied to the cell was about 7 V. The pH value was maintained in a range of 6 to 8. The obtained results are depicted in Table 6.

TABLE 6

The values for a degree of removal of ammonia, the specific charge (Qe), the specific energy consumption (We), and the current yield (CY).

| | Duration of process, h | | | | |
|---|---|---|---|---|---|
| | 0 | 1 | 2 | 3 | 4 |
| Ammonia concentration, mg/l | 135 | 100 | 56 | 20 | 0 |
| Ammonia removal degree, % | 0 | 25.9 | 58.5 | 85.2 | 100.0 |
| Qe, A × h/g | 0 | 22.5 | 20.0 | 20.6 | 23.4 |
| We, W × h/g | 0.0 | 167 | 140 | 144 | 164 |
| CY, % | 0.0 | 19.8 | 22. | 21.7 | 19.1 |

The data in the table show that the addition of 1 to 3 g/l of sodium chloride to the solution provides for complete removal of ammonia from the solution during 4 to 7 h, due to its oxidation by the products of anodic oxidation of chloride-ions (gaseous chlorine, hyporchlorite-ion and others).

Thus, the experiment showed that the efficient removal of ammonia from solutions by its electrochemical oxidation in a flow-type electrochemical modular cell is achieved by the addition of 1 to 3 g/l of sodium chloride in the processed solution with the processing being carried out with a simultaneous circulation of the solution through the cathode and anode chambers.

EXAMPLE 9

Figure 13:
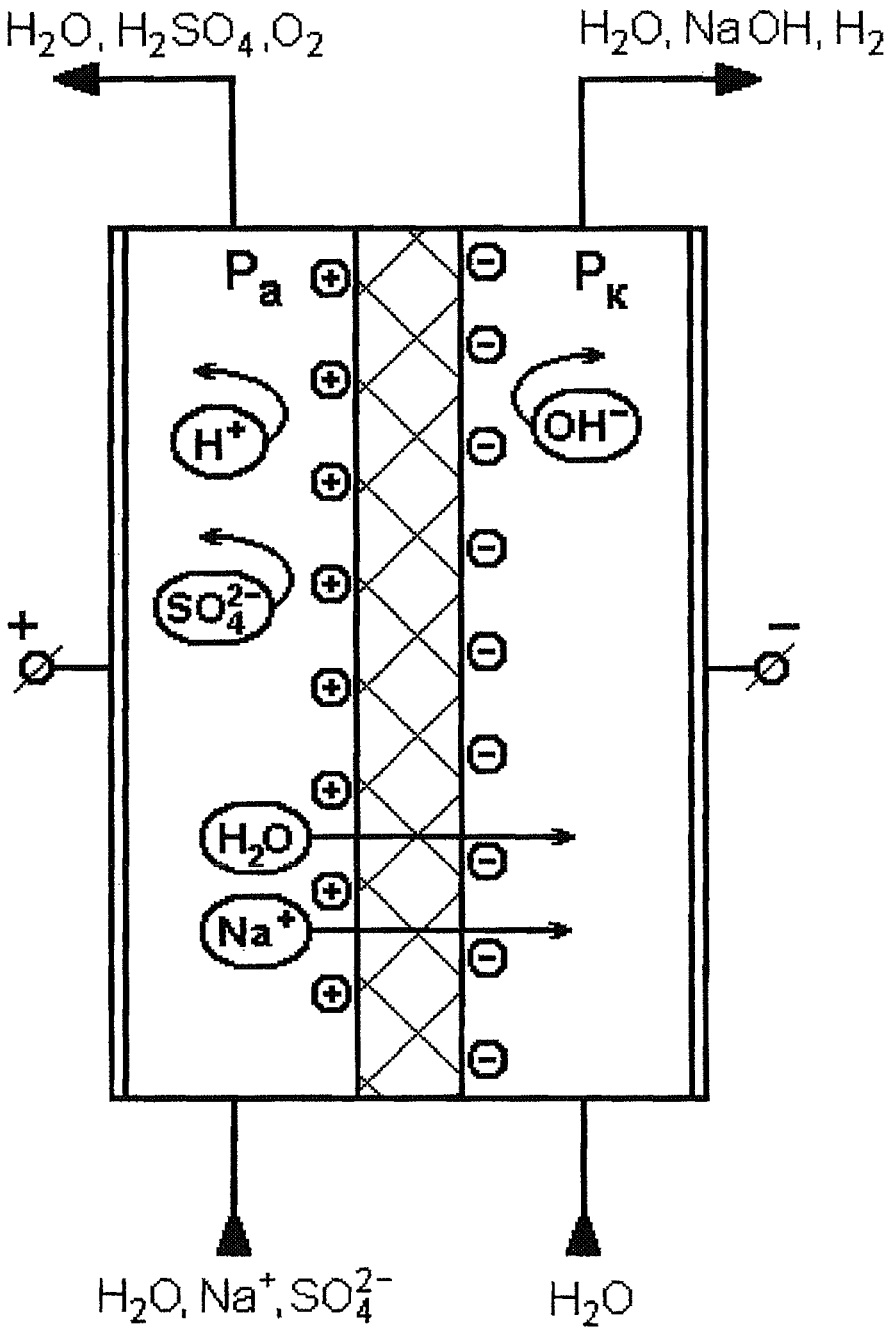
FIG. 13 a schematic representation of the production of sulfuric acid, hydrogen, and a sodium hydroxide solution from the initial solution of sodium sulfate.
Figure 14:
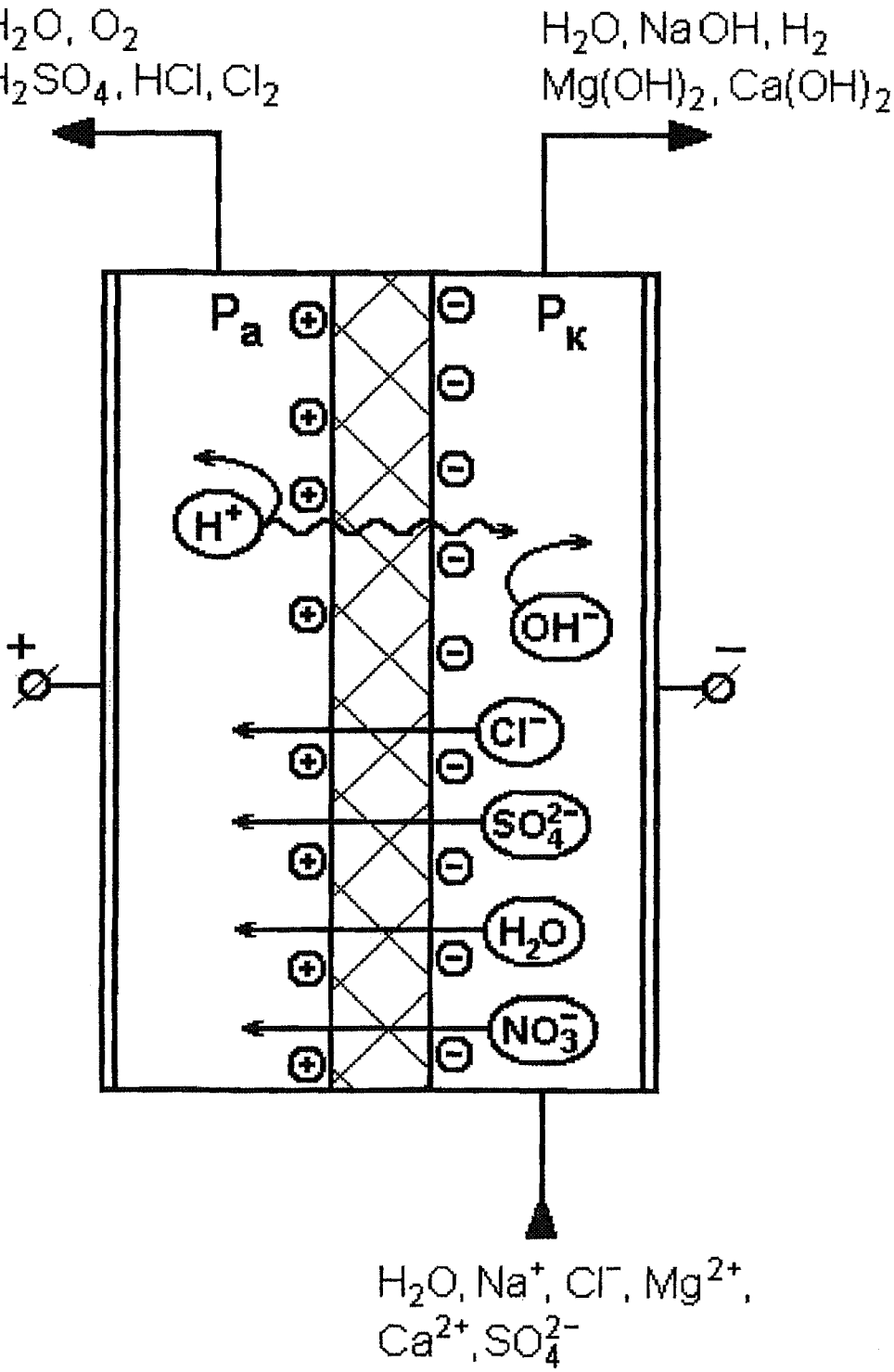
FIG. 14 a schematic representation of the production of electrochemically activated fresh water catholyte.

Preparation of Sulfuric Acid, Hydrogen, and Sodium Hydroxide from a Sodium Sulfate Solution The process was carried out in the electrochemical cell No. 1 (Table 2 and FIG. 8*d*). The schematic diagram of the process is shown in FIG. 13. A sodium sulfate solution of the concentration 100 g/l was fed in dosed amounts to the anode chamber at a rate of 0.25 l/h. Fresh water was supplied to the cathode chamber at a rate of 0.6 l/h. The pressure in the anode chamber exceeded that in the cathode chamber by 0.4 kGs/cm$^2$. Under the action of the electric current of 25 to 35 A passed through the cell, sodium ions migrate from the anode chamber to the cathode chamber yielding sodium hydroxide. The overall reaction is described by the following reaction:

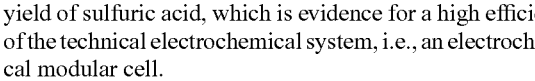

$$Na_2SO_4+4H_2O \rightarrow 2NaOH+H_2SO_4+2H_2+O_2$$

The optimization of the cell operation in respect of the current and rate of feed of sodium sulfate and water to the anode chamber makes it possible to achieve the 95 to 97% yield of sulfuric acid, which is evidence for a high efficiency of the technical electrochemical system, i.e., an electrochemical modular cell.

EXAMPLE 10

Preparation of Chlorine, Hydrogen, and Sodium Hydroxide from an Alkali Metal Chloride Solution The electrochemical cell No. 1 (Table 2 and FIG. 8*c*), wherein the anode and cathode are arranged at the interelectrode distance (IED) 10 mm, was used. The diaphragm was made of ceramics having the following composition: 70% of zirconium oxide, 27% of alumina, and 3% of yttrium oxide. The surface of the titanium anode comprised an OPTA coating; the entry and exit sockets of the anode chamber were made of BT1-00 titanium; the diaphragm sealants were made of an F4 fluoroplastic.

The process flow diagram of the electrochemical modular cell (FIG. 6) characterizes the fundamentally new technological process; namely, an ion-selective electrolysis comprising a diaphragm, which provides for a complete separation of the initial saline solution having a concentration of 180 to 250 g/l in electrochemical modular cells during one operational cycle (which rules out the anolyte return to regeneration, freezing a salt from the catholyte and return of the salt into the process, addition of the acid to the anode circuit, and high-grade purification of the saline solution) into a moist mixture of gaseous oxidants (chlorine, chlorine dioxide, and ozone) and a sodium hydroxide solution having the concentration 150 to 170 g/l, with a degree of conversion of the salt being from 98 to 99.5% and the electric power consumption ranging from 2 to 3 kW×h per kg of the gaseous mixture of oxidants. These parameters are very close to the theoretical values; therefore, the process of ion-selective electrolysis of a sodium chloride solution comprising a diaphragm is beyond comparison among the known electrochemical systems and processes.

The basic reaction that takes place in an electrochemical cell is the liberation of molecular chlorine in the anode chamber and the formation of sodium hydroxide in the cathode chamber:

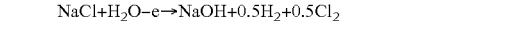

$$NaCl+H_2O-e \rightarrow NaOH+0.5H_2+0.5Cl_2$$

Simultaneously, with a lower yield, there take place the reactions of synthesis of chlorine dioxide directly from the saline solution and from the sulfuric acid, which is formed due to dissolution of molecular chlorine in the anode medium ($Cl_2+H_2O \leftrightarrow HClO+HCl$):

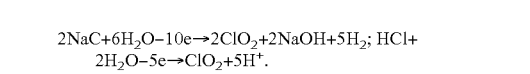

$$2NaC+6H_2O-10e \rightarrow 2ClO_2+2NaOH+5H_2;\ HCl+2H_2O-5e \rightarrow ClO_2+5H^+.$$

Also, in the anode chamber, there takes place the formation of ozone due to the direct decomposition of the water and oxidation of the liberated oxygen:

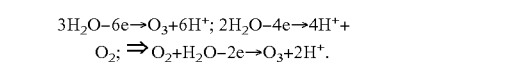

$$3H_2O-6e \rightarrow O_3+6H^+;\ 2H_2O-4e \rightarrow 4H^++O_2;\ \Rightarrow O_2+H_2O-2e \rightarrow O_3+2H^+.$$

With a low current yield, there take place the reactions of formation of the active oxygen compounds:

$$H_2O-2e \rightarrow 2H^++O.;\ H_2O-e \rightarrow HO.+H^+;\ 2H_2O-3e \rightarrow HO_2+3H^+.$$

The process of ion-selective electrolysis was performed in the following way. A sodium chloride solution of the concentration 200 g/l was fed in dosed amounts to the anode chamber at a rate of 0.3 l/h. The pressure of 1.1 kGs/cm$^2$ in the anode chamber was maintained by a pressure stabilizer mounted at the exit of the anode chamber (is not shown in FIG. 6). After the cathode chamber, wherein the pressure was equal to the atmospheric one, was filled with a filtrate coming from the anode chamber, the voltage of 3.2 V was applied to the cell electrodes from a dc source. Simultaneously, the current of 30 A was passed through the cell. The output of the electrochemical cell under study was about 40 g of oxidants per hour in equivalence to chlorine, which exceeds the specific parameters of the commercial chlorine electrolyzers.

EXAMPLE 11

Preparation of the Electrochemically Activated Fresh Water Catholyte in the Process of Preparing the Irrigation Water Enriched with Nitrogen Fertilizers The electrochemical cell No. 5 (Table 2 and FIG. 8*b*) was used for preparing the electrochemically activated fresh water catholyte. The foundations of the process was laid in the works by Justus Liebig, the author of the theory of mineral fertilizing of plants, who had shown almost two centuries ago that rain-water contains natural nitrogen fertilizers absorbed by the water from the atmosphere. The concentration of the fertilizers in the atmospheric water is only parts per milligram in a liter. However, with such a small content of the fertilizers, rain-water produces such effect on the plant growth that can not be obtained by irrigation with water from terrestrial water sources even if the supplies thereof are more than adequate.

It is expedient that the properties of rain water should be imparted to the usual irrigation water from terrestrial water sources. "Artificial rain water" can be prepared by returning to the irrigation water the fertilizers (and in the same amounts) that were taken away by the soil from the atmospheric water percolating through the soil.

Hence, a particular conclusion can be drawn that it is not only unreasonable but sometimes harmful to use concentrated liquid fertilizers, as it is the current practice. In particular, ammonia water gets into the soil at a concentration that is 25,000 to 50,000 times as that in rain water and, naturally, it kills every living substance.

Nitrogen fertilizers are essential for the normal growth and development of plants.

However, the known processes of preparation and use of nitrogen fertilizers are environmentally unsafe. Based on the known methods, it is impossible to develop an environmentally safe production of nitrogen fertilizers, since they rely on traditional approaches, i.e. synthesis of fertilizers with an obligatory formation of waste products; neutralization of the waste products (nitrogen oxides and acid sewage); application of fertilizers to the soil (inevitably associated with mineralization of the soil); removal of excess salts from the soil by washing it out with drain water. The above approaches underlie the known processes of producing nitrogen fertilizers, in particular, sodium nitrate and calcium nitrate.

The known processes involve the use of devices of the specific intended use, such as inventors, absorbers, desorbers, heat exchangers, refrigerators, filters, settlers, superheaters, condensers, evaporators, crystallizers, drying drums, and other equipment. There are used chemical reagents, such as caustic soda, soda ash, sodium chloride, calcium and magnesium hydroxides, sulfuric and nitric acids, and others. There are used electric power, steam, and hot water.

Hence, the process of preparation of nitrate fertilizers is associated with contamination of the environment with harmful substances.

Irrespective of the technical level of a production process, it inevitably contaminates the environment and deteriorates the ecology. At present, the preparation of 1 ton of sodium nitrate requires 0.455 tons of nitric acid, 0.03 tons of soda, 2.5 tons of steam (8 atm.), 65 $m^3$ of pure water, and 120 kW·h of electric power. The waste is 0.38 tons of nitrogen oxides per 1 ton of sodium nitrate.

The electrochemical approaches realized in the electrochemical modular cells make it possible to carry out an environmentally safe process of preparing nitrogen fertilizers. Sodium nitrate, calcium nitrate, magnesium nitrate, and potassium nitrate are synthesized directly from salts (chlorides, sulfates, and carbonates) dissolved naturally in the irrigation water.

The water is subjected to the electrochemical cathodic pretreatment in an electrochemical reactor and then is added with nitric acid of the concentration that provides for the alkalinity value ranging from 6.5 to 7.5 (depending on the soil composition).

Figure 6:
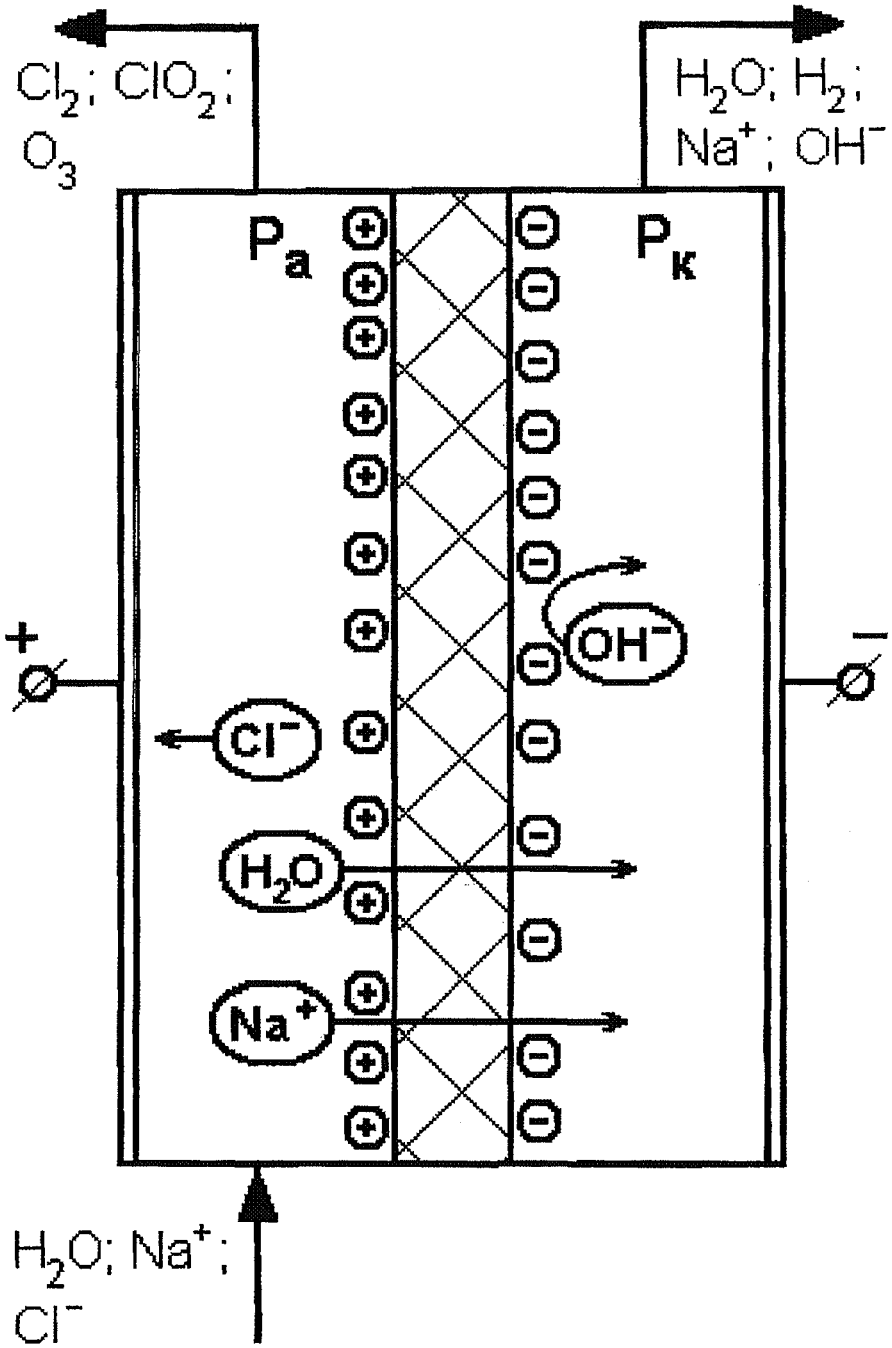
FIG. 6 is a schematic representation of the ion-selective electrolysis in the cell comprising a diaphragm. The diaphragm is made of oxide-zirconium ceramics. The anode product of the process is a humid gaseous mixture of molecular chlorine (about 95%), chlorine dioxide (about 3%), and ozone (about 2%). The initial solution is a solution of sodium chloride of a concentration over 100 g/l. The pressure in the anode chamber ($P_a$) is higher than the pressure in the cathode chamber in a value providing the ion-selective removal of sodium ions from the anode chamber at a given electric field intensity in the diaphragm.
Figure 7:
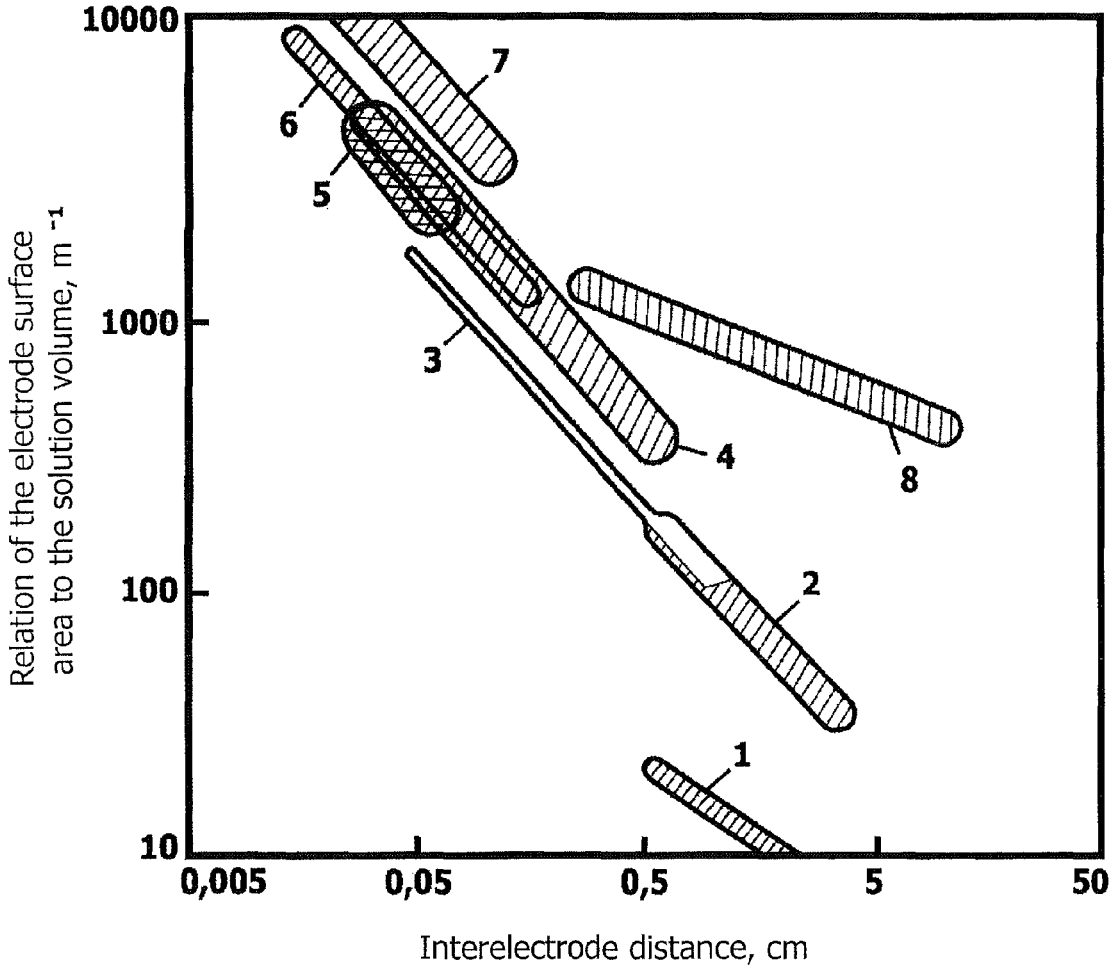
FIG. 7 is a graph of the relation of the electrode surface area to the solution volume as a function of the interelectrode space in different types of electrolyzers: (1) chloric electrolyzer comprising a mercury cathode; (2) filter-press electrolyzer; (3) capillary electrolyzer; (4) tower electrolyzer; (5) rolling electrolyzer; (6) electrolyzer comprising fluidized-bed electrodes; (7) electrolyzer comprising bulk or porous electrodes; (8) cylindrical electrochemical modular cell comprising a zirconium oxide diaphragm.

The above process was carried out under laboratory conditions. The aim of the process was to prepare an electrochemically activated fresh water catholyte with the extremely small volume of the anolyte produced. The process flow diagram of the electrochemical modular cell is shown in FIG. 6. Fresh irrigation water having the mineralization of 0.24 g/l was pumped through the cathode chamber of the cell, wherein the pressure was higher than that in the anode chamber by 0.8 $kGs/cm^2$. Before the water stream was fed into the cathode chamber, it passed through the internal cavity of the anode and cooled it. The water flow rate ranged from 10 to 20 l/h. After the anode chamber was filled with the filtrate from the cathode chamber, the electric power source was switched on and the electric current of 2 A was passed through the cell electrodes. In the beginning of the process, the voltage at the electrodes was 25 V and was decreased to a constant value of 15 V within one minute, as a result of increasing the electric conductivity of the anode chamber medium and stabilization of the concentration of electrolytes in the anode chamber, which provided for a constant voltage at the cell electrodes. The catholyte pH measurements showed that pH of the catholyte was 10.6 at a flow rate of 20 l/h and 11.1 at a flow rate of 10 l/h. As the catholyte was neutralized to pH=7 with a weak solution of nitric acid, the cathode treated water flowing at a rate of 20 l/h contained 5.2 mg/l of nitrogen fertilizers; the water flowing at a rate of 10 l/h contained 9.7 mg/l.

As the water after the electrochemical cathode treatment (the catholyte) is mixed with a very small amount of nitric acid, there takes place a reaction of neutralization of the nitric acid with alkali and alkaline earth metals; as a result, there are formed calcium, sodium, and other metals nitrates that are effective nitrogen fertilizers:

$$HNO_3+NaOH \rightarrow NaNO_3+H_2O$$

$$HNO_3+Ca(OH)_2 \rightarrow Ca(NO_3)_2+H_2O$$

The nitrogen compounds enriched water can be used for irrigation of areas of agricultural plants. The water subjected to the electrochemical cathodic treatment in the electrochemical modular cell remains, for some time after the end of the electrochemical treatment, in the continued metastable state, which is characterized in an abnormal reactivity.

The enhanced biological activity of fertilizers produced in accordance with the above method is due to the fact that interaction of the highly metastable water is associated with the formation of ion-hydrate sheathes around the nitrate ions in the solution, which have a specific long-term structure. The specificity of the hydrate sheath structure has a significant effect on the assimilation of the fertilizers and, consequently, on the efficiency of the fertilizers. Accordingly, a solution of nitrogen fertilizers in water obtained in that way retains its high biological activity for nearly 3 months.

The environmental, safety of the above process of preparation of nitrate fertilizers is accounted for by the fact that that process is not associated with atmospheric emission of contaminants and the application of fertilizers prepared in accordance with the above method does not lead to enhanced mineral contamination of the soil, because the alkali and alkaline-earth metals nitrates are synthesized from salts that are dissolved naturally in the irrigation water. The studies showed that the optimum concentration, which provides for the biological need of plants, is the nitrate content of 5 to 15 mg per 1 l of irrigation water. Also, it was shown that irrigation of plants with the water having the low nitrate content during the whole vegetation period makes it possible to increase the crop productivity and biological value of the products.

A periodical introduction of fertilizers to the soil by the known methods leads to contamination of the environment and crop products, since the traditional liquid nitrate fertilizers have a concentration that is 25,000 to 50,000 times higher than the biologically optimum one.

A non-uniform distribution of fertilizers introduced by the known methods, i.e., periodically, adversely affects the crop productivity.

The experimental studies showed up the feasibility of the effective electrochemical transformation of water in a modular cell and confirmed the fact that the total costs of the electrochemical production of nitrogen fertilizers in the irrigation water may be 9 to 11 times less than those of the traditional production

INDUSTRIAL APPLICABILITY

The invention makes it possible to intensify the processes of electrolysis in a diaphragm-type cell both due to the improvement of the cell design and the order of arrangement of the basic elements thereof—electrodes and the diaphragm, and to upgrade the characteristics of a diaphragm-type cell up to those of the electrolyzers comprising bulk and fluidized-bed electrodes. The application of a diaphragm made of special materials in the cell and the application of a diaphragm and electrodes having different ratios of apparent and true physical surface areas of the electrodes and diaphragm make it possible to extend the cell functionalities in processing electrolytes of different types.

The invention claimed is:

1. A cylindrical electrochemical cell for processing solutions, said cell comprising:

an inner hollow anode configured as a titanium tube having a constant wall thickness;

an outer cylindrical cathode configured as a titanium tube having a constant wall thickness;

a permeable tubular ceramic diaphragm based on aluminum oxide arranged between said anode and cathode and dividing the interelectrode space into anode and cathode chambers and also having a constant wall thickness;

units for mounting, securing and sealing the electrodes and the diaphragm located at the end sections of the cell; and devices for supplying the processed solutions in the electrode chambers and removing said solutions therefrom;

the anode, cathode, diaphragm are arranged in said units and connected to said devices for supplying and removing the processed solutions so that a working section of the cell is formed, the anode is configured with a developed outer surface, on which an electrocatalytic coating is applied, with the ratio of the true surface area of the anode and the true surface area of the cathode being equal or greater than unity;

wherein the outer true surface area of the diaphragm being equal or less than the true surface area of the cathode, and the true inner surface area of the diaphragm being equal or less than the true surface area of the anode but less than the true outer surface area of the diaphragm, and the product of the interelectrode distance and the quotient of the division of the total true surface areas of the anode and cathode by the total volume of the electrode chambers is 3.9 to 4.1, and the ratio of the cross-sectional area of the cathode chamber to the total cross-sectional area of the anode chamber and the diaphragm ranges from 0.9 to 1.0, and the length of the working section of the cell is 15-25 times the outside diameter of the anode.

2. The cylindrical electrochemical cell for processing solutions of claim 1 wherein the ceramic diaphragm of the cell is capillary-porous and electroosmotically active, said diaphragm being made of aluminum oxide grains of the specific surface area 1 to 4 $m^2/g$ covered by alumina particles of the specific surface area 10 to 40 $m^2/g$; with the content of alumina particles of the specific surface area 1 to 4 $m^2/g$ being 70 to 90 wt %; with no less than 99% of the alumina phase composition being in the alpha form.

3. The cylindrical electrochemical cell for processing solutions of claim 1, wherein the ceramic diaphragm of the cell is capillary-porous and electroosmotically active, said diaphragm being made of alumina grains of the specific surface area 1 to 4 $m^2/g$ covered by a mixture of particles of titanium oxide and magnesium oxide, with the content of alumina particles being no less than 99 wt %; with no less than 99% of the alumina phase composition being in the alpha form.

4. The cylindrical electrochemical cell for processing solutions of claim 1, wherein the ceramic diaphragm of the cell is capillary-porous and electroosmotically active, said diaphragm being made of alumina grains of the specific surface area 1 to 4 $m^2/g$ covered by zirconium dioxide particles partially stabilized with oxides of rare or rare-earth metals and has the following composition: 60 to 90 wt % of alumina with no less than 98% of the alumina phase content being in the alpha form, and 10 to 40 wt % of zirconium dioxide with no less than 98% of the zirconium dioxide phase content being in the tetragonal modification.

5. The cylindrical electrochemical cell for processing solutions of claim 4, wherein the stabilized zirconium dioxide in the tetragonal phase contains one or more oxides selected from the group comprising oxides of yttrium, scandium, ytterbium, cerium, and gadolinium, in total of 1.0 to 10.0 wt %.

6. The cylindrical electrochemical cell for processing solutions of claim 5, wherein the anode cavity comprises devices for supplying and removing a heat carrier.

7. The cylindrical electrochemical cell for processing solutions of claim 1, wherein the units for securing the electrodes and the diaphragm are made in the form of one or more parts each made of a dielectric material, the devices for supplying and removing the solutions into and out of the cathode chambers are made in the form of channels and sockets integrated in the unit parts, and the devices for supplying and removing the solutions into and out of the anode chambers are made in the form of sockets connected with the inner cavity of the anode and located at the ends thereof with the anode end sections comprising apertures.

8. The cylindrical electrochemical cell for processing solutions of claim 1, wherein the units for securing the electrodes and the diaphragm are made in the form of one or more parts each made of a dielectric material, the devices for supplying and removing the solutions into and out of the cathode chambers are made in the form of apertures and sockets located at the cathode end sections, and the devices for supplying and removing the solutions into and out of the anode chambers are made in the form of sockets connected with the inner cavity of the anode with the anode end sections comprising apertures.

9. The cylindrical electrochemical cell for processing solutions of claim 7, wherein the anode body comprises additional apertures located uniformly along the full length of the working section of the cell.

* * * * *